US009205688B2

(12) United States Patent
Ikeda et al.

(10) Patent No.: US 9,205,688 B2
(45) Date of Patent: Dec. 8, 2015

(54) INKJET PRINTING SYSTEM AND NON-TRANSITORY COMPUTER READABLE MEDIUM STORED WITH INKJET PRINT CONTROL PROGRAM

(71) Applicant: MIMAKI ENGINEERING CO., LTD., Nagano (JP)

(72) Inventors: Akira Ikeda, Nagano (JP); Hisayuki Kobayashi, Nagano (JP); Daisuke Kondo, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/647,129

(22) PCT Filed: Nov. 29, 2013

(86) PCT No.: PCT/JP2013/082151
§ 371 (c)(1),
(2) Date: May 26, 2015

(87) PCT Pub. No.: WO2014/084337
PCT Pub. Date: Jun. 5, 2014

(65) Prior Publication Data

US 2015/0314620 A1 Nov. 5, 2015

(30) Foreign Application Priority Data

Nov. 30, 2012 (JP) ..... 2012-263857

(51) Int. Cl.
*B41J 2/21* (2006.01)
*B41J 29/38* (2006.01)
*B41J 2/01* (2006.01)

(52) U.S. Cl.
CPC ... *B41J 29/38* (2013.01); *B41J 2/01* (2013.01)

(58) Field of Classification Search
CPC ..... B41J 29/38; B41J 2/01; B41J 29/393; B41J 13/26; B41J 2/04508; B41J 11/42; B41J 2029/3935; B41J 2/2132; B41J 13/0009; B41J 2/04505; B41J 2/145; B41J 2/2054
See application file for complete search history.

(56) References Cited

U.S. PATENT DOCUMENTS

2013/0286075 A1* 10/2013 Tamiya ..... B41J 13/26 347/16
2015/0174895 A1* 6/2015 Ogawa ..... B41J 29/393 347/14

FOREIGN PATENT DOCUMENTS

| | | |
|---|---|---|
| JP | 2007-136764 | 6/2007 |
| JP | 2009-73638 | 4/2009 |
| JP | 2010-5903 | 1/2010 |

OTHER PUBLICATIONS

"International Search Report (Form PCT/ISA/210)", mailed on Feb. 4, 2014, with English translation thereof, pp. 1-2.

*Primary Examiner* — Thinh Nguyen
(74) *Attorney, Agent, or Firm* — Jianq Chyun IP Office

(57) ABSTRACT

The inkjet printing system includes a print information receiving unit that receives print information including work piece types, print images, and print conditions (S231), an image arrangement deciding unit that decides an image arrangement that is an arrangement of the print images on a pallet (S232 to S242), a work piece arrangement outputting unit that outputs a work piece arrangement that is an arrangement of work pieces according to the image arrangement (S243), and a print executing unit that executes printing on the work pieces on the pallet based on the print image, print conditions, and image arrangement, wherein the image arrangement deciding unit decides the image arrangement in a state where a plurality of print images with the common specific print conditions being predetermined conditions among the print conditions is aligned in a main scanning direction (S232, S233).

5 Claims, 19 Drawing Sheets

| Workpiece type | Print image | Print condition | | | | Printing number |
|---|---|---|---|---|---|---|
| | | Resolution | Pass number | White base | Number of clear coating | |
| Type A | Image Z | 720 × 900dpi | 12pass | Present | 1 | 1 |
| Type A | Image Y | 1440 × 1200dpi | 16pass | Not Present | 0 | 7 |
| Type A | Image X | 720 × 900dpi | 12pass | Present | 1 | 2 |
| Type B | Image W | 1440 × 1200dpi | 16pass | Present | 2 | 1 |
| Type B | Image Z | 720 × 900dpi | 12pass | Present | 0 | 1 |
| Type C | Image V | 720 × 900dpi | 12pass | Not Present | 1 | 5 |
| Type B | Image X | 720 × 900dpi | 12pass | Present | 1 | 1 |
| Type C | Image U | 1440 × 1200dpi | 12pass | Present | 1 | 4 |
| ⋮ | ⋮ | ⋮ | ⋮ | ⋮ | ⋮ | ⋮ |

FIG.14

| I D | Workpiece type | Print image | Print condition | | | |
|---|---|---|---|---|---|---|
| | | | Resolution | Pass number | White base | Number of clear coating |
| 001 | Type A | Image Z | 720 × 900dpi | 12pass | Present | 1 |
| 002 | Type A | Image Y | 1440 × 1200dpi | 16pass | Not Present | 0 |
| ⋮ | ⋮ | ⋮ | ⋮ | ⋮ | ⋮ | ⋮ |
| 008 | Type A | Image Y | 1440 × 1200dpi | 16pass | Not Present | 0 |
| 009 | Type A | Image X | 720 × 900dpi | 12pass | Present | 1 |
| 010 | Type A | Image X | 720 × 900dpi | 12pass | Present | 1 |
| 011 | Type B | Image W | 1440 × 1200dpi | 16pass | Present | 2 |
| 012 | Type B | Image Z | 720 × 900dpi | 12pass | Present | 0 |
| 013 | Type C | Image V | 720 × 900dpi | 12pass | Not Present | 1 |
| ⋮ | ⋮ | ⋮ | ⋮ | ⋮ | ⋮ | ⋮ |
| 017 | Type C | Image V | 720 × 900dpi | 12pass | Not Present | 1 |
| 018 | Type B | Image X | 720 × 900dpi | 12pass | Present | 1 |
| 019 | Type C | Image U | 1440 × 1200dpi | 12pass | Present | 1 |
| ⋮ | ⋮ | ⋮ | ⋮ | ⋮ | ⋮ | ⋮ |

FIG.15

| I D | Workpiece type | Print image | Print condition | | | |
|---|---|---|---|---|---|---|
| | | | Resolution | Pass number | White base | Number of clear coating |
| 001 | Type A | Image Z | 720× 900dpi | 12pass | Present | 1 |
| 009 | Type A | Image X | 720× 900dpi | 12pass | Present | 1 |
| 010 | Type A | Image X | 720× 900dpi | 12pass | Present | 1 |
| 018 | Type B | Image X | 720× 900dpi | 12pass | Present | 1 |
| 002 | Type A | Image Y | 1440×1200dpi | 16pass | Not Present | 0 |
| 003 | Type A | Image Y | 1440×1200dpi | 16pass | Not Present | 0 |
| 004 | Type A | Image Y | 1440×1200dpi | 16pass | Not Present | 0 |
| 005 | Type A | Image Y | 1440×1200dpi | 16pass | Not Present | 0 |
| 006 | Type A | Image Y | 1440×1200dpi | 16pass | Not Present | 0 |
| 007 | Type A | Image Y | 1440×1200dpi | 16pass | Not Present | 0 |
| 008 | Type A | Image Y | 1440×1200dpi | 16pass | Not Present | 0 |
| 011 | Type B | Image W | 1440×1200dpi | 16pass | Present | 2 |
| 012 | Type B | Image Z | 720× 900dpi | 12pass | Present | 0 |
| ⋮ | ⋮ | ⋮ | ⋮ | ⋮ | ⋮ | ⋮ |

FIG.16

| Pallet number | Main scanning row number | Sub scanning row number | I D | Workpiece type | Print image | Print condition | | | |
|---|---|---|---|---|---|---|---|---|---|
| | | | | | | Resolution | Pass number | White base | Number of clear coating |
| 1 | 1 | 1 | 001 | Type A | Image Z | 720 × 900dpi | 12pass | Present | 1 |
| 1 | 1 | 2 | 009 | Type A | Image X | 720 × 900dpi | 12pass | Present | 1 |
| 1 | 1 | 3 | 010 | Type A | Image X | 720 × 900dpi | 12pass | Present | 1 |
| 1 | 1 | 4 | 018 | Type B | Image X | 720 × 900dpi | 12pass | Present | 1 |
| 1 | 2 | 1 | 002 | Type A | Image Y | 1440 × 1200dpi | 16pass | Not Present | 0 |
| 1 | 2 | 2 | 003 | Type A | Image Y | 1440 × 1200dpi | 16pass | Not Present | 0 |
| 1 | 2 | 3 | 004 | Type A | Image Y | 1440 × 1200dpi | 16pass | Not Present | 0 |
| 1 | 2 | 4 | 005 | Type A | Image Y | 1440 × 1200dpi | 16pass | Not Present | 0 |
| 1 | 3 | 1 | 006 | Type A | Image Y | 1440 × 1200dpi | 16pass | Not Present | 0 |
| 1 | 3 | 2 | 007 | Type A | Image Y | 1440 × 1200dpi | 16pass | Not Present | 0 |
| 1 | 3 | 3 | 008 | Type A | Image Y | 1440 × 1200dpi | 16pass | Not Present | 0 |
| 2 | 1 | 1 | 011 | Type B | Image W | 1440 × 1200dpi | 16pass | Present | 2 |
| 2 | 2 | 1 | 012 | Type B | Image Z | 720 × 900dpi | 12pass | Present | 0 |
| ⋮ | ⋮ | ⋮ | ⋮ | ⋮ | ⋮ | ⋮ | ⋮ | ⋮ | ⋮ |

FIG.17

| Pallet number | Main scanning row number | Sub scanning row number | I D | Workpiece type | Print image | Print condition | | | |
|---|---|---|---|---|---|---|---|---|---|
| | | | | | | Resolution | Pass number | White base | Number of clear coating |
| 1 | 1 | 1 | 001 | Type A | Image Z | 720 × 900dpi | 12pass | Present | 1 |
| 1 | 1 | 2 | 009 | Type A | Image X | 720 × 900dpi | 12pass | Present | 1 |
| 1 | 1 | 3 | 010 | Type A | Image X | 720 × 900dpi | 12pass | Present | 1 |
| 1 | 1 | 4 | 018 | Type B | Image X | 720 × 900dpi | 12pass | Present | 1 |
| 1 | 2 | 1 | 002 | Type A | Image Y | 1440 × 1200dpi | 16pass | Not Present | 0 |
| 1 | 2 | 2 | 003 | Type A | Image Y | 1440 × 1200dpi | 16pass | Not Present | 0 |
| 1 | 2 | 3 | 004 | Type A | Image Y | 1440 × 1200dpi | 16pass | Not Present | 0 |
| 1 | 2 | 4 | 005 | Type A | Image Y | 1440 × 1200dpi | 16pass | Not Present | 0 |
| 1 | 3 | 1 | 006 | Type A | Image Y | 1440 × 1200dpi | 16pass | Not Present | 0 |
| 1 | 3 | 2 | 007 | Type A | Image Y | 1440 × 1200dpi | 16pass | Not Present | 0 |
| 1 | 3 | 3 | 008 | Type A | Image Y | 1440 × 1200dpi | 16pass | Not Present | 0 |
| 1 | 3 | 4 | 011 | Type B | Image W | 1440 × 1200dpi | 16pass | Present | 2 |
| 2 | 1 | 1 | 012 | Type B | Image Z | 720 × 900dpi | 12pass | Present | 0 |
| ⋮ | ⋮ | ⋮ | ⋮ | ⋮ | ⋮ | ⋮ | ⋮ | ⋮ | ⋮ |

FIG.18

| Pallet number | Main scanning row number | Sub scanning row number | Workpiece type |
|---|---|---|---|
| 1 | 1 | 1 | Type A |
| 1 | 1 | 2 | Type A |
| 1 | 1 | 3 | Type A |
| 1 | 1 | 4 | Type B |
| 1 | 2 | 1 | Type A |
| 1 | 2 | 2 | Type A |
| 1 | 2 | 3 | Type A |
| 1 | 2 | 4 | Type A |
| 1 | 3 | 1 | Type A |
| 1 | 3 | 2 | Type A |
| 1 | 3 | 3 | Type A |
| 1 | 3 | 4 | Type B |
| 2 | 1 | 1 | Type B |
| ⋮ | ⋮ | ⋮ | ⋮ |

FIG.19

INKJET PRINTING SYSTEM AND NON-TRANSITORY COMPUTER READABLE MEDIUM STORED WITH INKJET PRINT CONTROL PROGRAM

CROSS-REFERENCE TO RELATED APPLICATION

This application is a 371 application of the International PCT application serial no. PCT/JP2013/082151, filed on Nov. 29, 2013, which claims the priority benefit of Japan application no. 2012-263857, filed on Nov. 30, 2012. The entirety of each of the above-mentioned patent applications is hereby incorporated by reference herein and made a part of this specification.

TECHNICAL FIELD

The present invention relates to an inkjet printing system provided with a recording head that discharges ink.

BACKGROUND ART

Conventionally, there is known an inkjet printing system provided with a relative movement device that moves a recording head in a main scanning direction and a sub scanning direction relative to a medium mounting stage on which a plurality of target media, being media for printing, can be loaded (see Patent Document 1).

PRIOR ART DOCUMENT

Patent Document

Patent Document 1: Japanese Patent Laid-open Publication No. 2009-73638

SUMMARY OF THE INVENTION

Problem to be Solved by the Invention

In a case where a print image that is an image to be printed on a target medium and print information being information including print conditions of this print image are received, and when for example an image arrangement that is an arrangement of the print image on a medium mounting stage is set in a state where a plurality of print images having different pass number for printing the print image is aligned in a main scanning direction, among the print conditions, an inkjet printing system needs to execute series of printing operations, which are executed by repeating ink discharge in the main scanning direction of discharging the ink onto the target media on the medium mounting stage by using the recording head while relatively moving the recording head in the main scanning direction relative to the medium mounting stage and the relative movement of the recording head in the sub scanning direction relative to the medium mounting stage, independently for the plurality of print images aligned in the main scanning direction according to each of the print conditions. Accordingly, in the case where the image arrangement is set in the state where the plurality of print images with different print conditions are aligned in the main scanning direction, the inkjet printing system has a problem that a total length of time required for the printing on the plurality of target media on the medium mounting stage sometimes becomes long.

To reduce the total time required for the printing on the plurality of target media on the medium mounting stage, it is preferable to have the image arrangement set in a state where a plurality of print images having a common specific condition among the print conditions is aligned in the main scanning direction.

However, in the conventional inkjet printing system, since a user sets the image arrangement, there are problems that the user needs to carefully consider the image arrangement so as to set the image arrangement that can reduce the total time required for the printing on the plurality of target media on the medium mounting stage, and that the consideration itself requires skill.

Thus, the present invention aims to provide an inkjet printing system that can simplify the setting that is required to be executed by the user for efficient printing on the plurality of target media on the medium mounting stage compared to in the conventional technique.

Solution to the Problem

An inkjet printing system of the present invention is provided with an inkjet printer including: a recording head that discharges ink; a relative movement device that relatively moves the recording head in a main scanning direction and a sub scanning direction relative to a medium mounting stage on which a plurality of target media, being media for printing, is capable of being loaded; and an information output section that outputs information, wherein the inkjet printing system includes: a print information receiving unit that receives print information being information including medium types that are types of the target media, print images that are images to be printed on the target media, and print conditions for the print images; an image arrangement deciding unit that decides an image arrangement that is an arrangement on the medium mounting stage of the print images included in the print information received by the print information receiving unit; a medium arrangement outputting unit that causes the information output section to output a medium arrangement that is an arrangement of the target media in accordance with the image arrangement decided by the image arrangement deciding unit; and a print executing unit that executes printing on the target media on the medium mounting stage by using the recording head and the relative movement device, wherein the print executing unit executes printing based on the print images and the print conditions included in the print information received by the print information receiving unit, and the image arrangement decided by the image arrangement deciding unit, and the image arrangement deciding unit decides the image arrangement in a state where a plurality of the print images with a common specific print condition, which is a predetermined condition among the print conditions, is aligned in the main scanning direction.

According to this configuration, the inkjet printing system of the present invention can present a medium arrangement corresponding to the image arrangement for reducing the total time required for the printing on the plurality of target media on the medium mounting stage simply by setting the print information by the user. Accordingly, the user of the inkjet printing system can reduce the total time required for the printing on the plurality of target media on the medium mounting stage by the inkjet printing system simply by arranging the plurality of target media on the medium mounting stage in accordance with the medium arrangement presented by the inkjet printing system. That is, the inkjet printing system of the present invention can simplify the settings required to be executed by the user for efficient printing on the plurality of target media on the medium mounting stage compared to in the conventional technique.

Further, in the inkjet printing system of the present invention, the number of printing of the print images may be included in the print information.

According to this configuration, the inkjet printing system of the present invention does not have to have the user designate each of the plurality of pieces of print information having the common medium type, print image, and print condition, whereby the settings of the print information by the user can be simplified compared to a configuration in which the user is required to designate each of the plurality of pieces of print information of which medium type, print image, and print condition are common. That is, the inkjet printing system of the present invention can further simplify the settings required to be executed by the user for the efficient printing on the plurality of target media on the medium mounting stage.

Further, the inkjet printing system of the present invention may further include a stage replacing device that automatically replaces a medium mounting stage on which a target for printing is loaded among a plurality of the medium mounting stages, wherein the print executing unit executes printing on the target media on the medium mounting stages based on the print images and the print conditions included in the print information received by the print information receiving unit and the image arrangement decided by the image arrangement deciding unit, and by using the recording head, the relative movement device, and the stage replacing device, and in a case where the number of replacement of the medium mounting stages by the stage replacing device decreases when a plurality of the print images with different specific print conditions is aligned in the main scanning direction, the image arrangement deciding unit decides the image arrangement in the state in which the plurality of the print images is aligned in the main scanning direction, if printing time required in the state where the plurality of the print images is aligned in the main scanning direction is shorter than printing time required in a state where said plurality of the print images is not aligned in the main scanning direction.

According to this configuration, the inkjet printing system of the present invention can present the user with the medium arrangement in which the time for the automatic replacement of the medium mounting stages by the stage replacing device is taken into consideration, so that the total time required for the printing on the plurality of target media on the medium mounting stage can be reduced compared to a configuration that presents the user with a medium arrangement in which the time for the automatic replacement of the medium mounting stages by the stage replacing device is not taken into consideration. That is, the inkjet printing system of the present invention can further enhance efficiency of the printing on the plurality of target media on the medium mounting stage.

A non-transitory computer readable medium stored with an inkjet print control program of the present invention is provided. The inkjet print control program to be executed by a computer is provided in an inkjet printing system that is provided with an inkjet printer including a recording head that discharges ink; and a relative movement device that relatively moves the recording head in a main scanning direction and a sub scanning direction relative to a medium mounting stage on which a plurality of target media, being media for printing, is capable of being loaded; and the computer including an information output section that outputs information, and configured to control the inkjet printer, wherein the inkjet print control program causes the computer to function as: a print information receiving unit that receives print information being information including medium types that are types of the target media, print images that are images to be printed on the target media, and print conditions for the print images; an image arrangement deciding unit that decides an image arrangement that is an arrangement on the medium mounting stage of the print images included in the print information received by the print information receiving unit; a medium arrangement outputting unit that causes the information output section to output a medium arrangement that is an arrangement of the target media in accordance with the image arrangement decided by the image arrangement deciding unit; and a print executing unit that executes printing on the target media on the medium mounting stage by using the recording head and the relative movement device, wherein the print executing unit executes printing based on the print images and the print conditions included in the print information received by the print information receiving unit, and the image arrangement decided by the image arrangement deciding unit, and the image arrangement deciding unit decides the image arrangement in a state where a plurality of the print images with a common specific print condition, which is a predetermined condition among the print conditions, is aligned in the main scanning direction.

According to this configuration, the computer that executes the inkjet print control program of the present invention can present to a user a medium arrangement corresponding to the image arrangement for reducing the total time required for the printing on the plurality on target media on the medium mounting stage to be performed by the inkjet printer simply by setting the print information by the user. Accordingly, the user of the computer that executes the inkjet print control program of the present invention can reduce the total time required for the printing on the plurality of target media on the medium mounting stage by the inkjet printer simply by arranging the plurality of target media on the medium mounting stage in accordance with the medium arrangement presented by the computer. That is, the computer that executes the inkjet print control program of the present invention can simplify the settings required to be executed by the user for efficient printing on the plurality of target media on the medium mounting stage by the inkjet printer compared to in the conventional technique.

Effects of the Invention

The inkjet printing system of the present invention can simplify the settings required to be executed by a user for efficient printing on a plurality of target media on the medium mounting stage compared to in the conventional technique.

BRIEF DESCRIPTION OF THE DRAWINGS

FIG. 14 is a diagram showing an example of the print information received by a print information receiving unit shown in FIG. 7.

FIG. 15 is a diagram showing information in which print images in the print information shown in FIG. 14 are independently separated, and ID is given to each of the print images.

FIG. 16 is a diagram showing information that the information shown in FIG. 15 is rearranged by common specific print condition.

FIG. 17 is a diagram showing information that the information shown in FIG. 16 is grouped by pallet group and main scanning row group.

FIG. 18 is a diagram showing information that the information shown in FIG. 17 is grouped by new pallet group and main scanning row group.

FIG. 19 is a diagram showing information on a workpiece arrangement generated based on the information shown in FIG. 18.

EMBODIMENTS OF THE INVENTION

Hereinbelow, an embodiment of the present invention will be described with reference to the drawings.

Firstly, a configuration of an inkjet printing system according to the present embodiment will be described.

Figure 1:
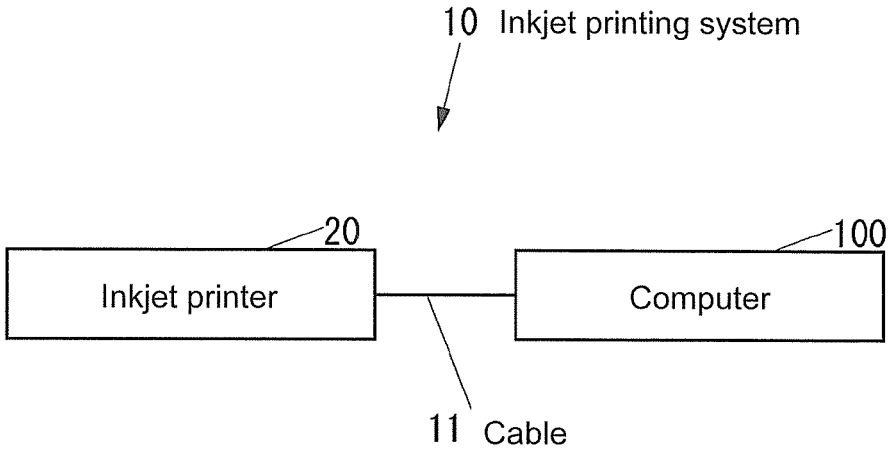
FIG. 1 is a block diagram of an inkjet printing system according to an embodiment of the present invention.

FIG. 1 is a block diagram of an inkjet printing system 10 according to the present embodiment.

As shown in FIG. 1, the inkjet printing system 10 includes an inkjet printer 20, and a computer 100 that controls the inkjet printer 20. The inkjet printer 20 and the computer 100 are connected so as to be communicable with each other via a cable 11 such as a USB (Universal Serial Bus) cable. It should be noted that the inkjet printer 20 and the computer 100 may be connected so as to be communicable with each other via a network such as a LAN (Local Area Network) or the Internet, instead of the cable 11.

Figure 2:
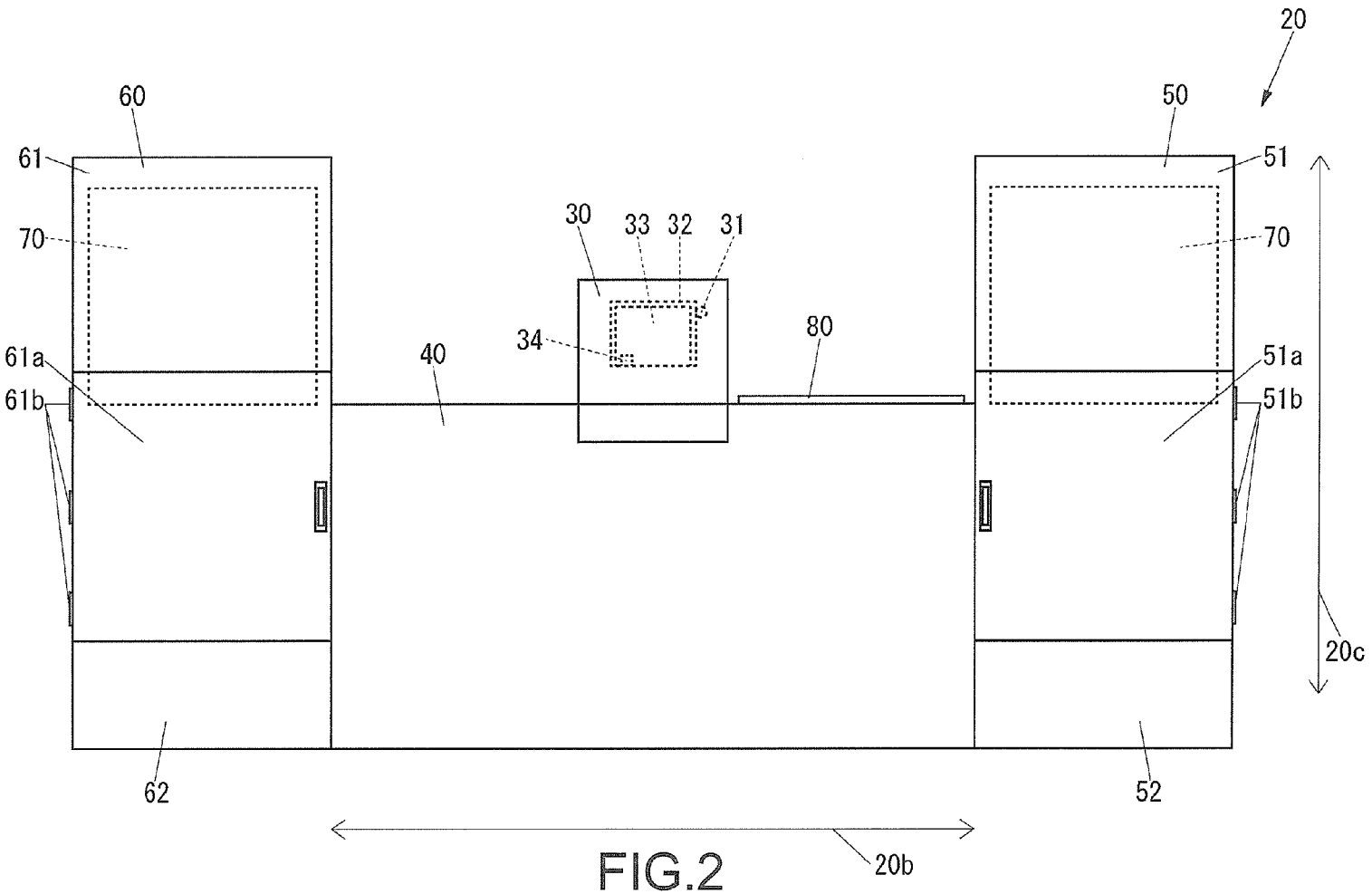
FIG. 2 is a front view of an inkjet printer shown in FIG. 1, in a state where a pallet is being transferred between a supply device and a main body.
Figure 3:
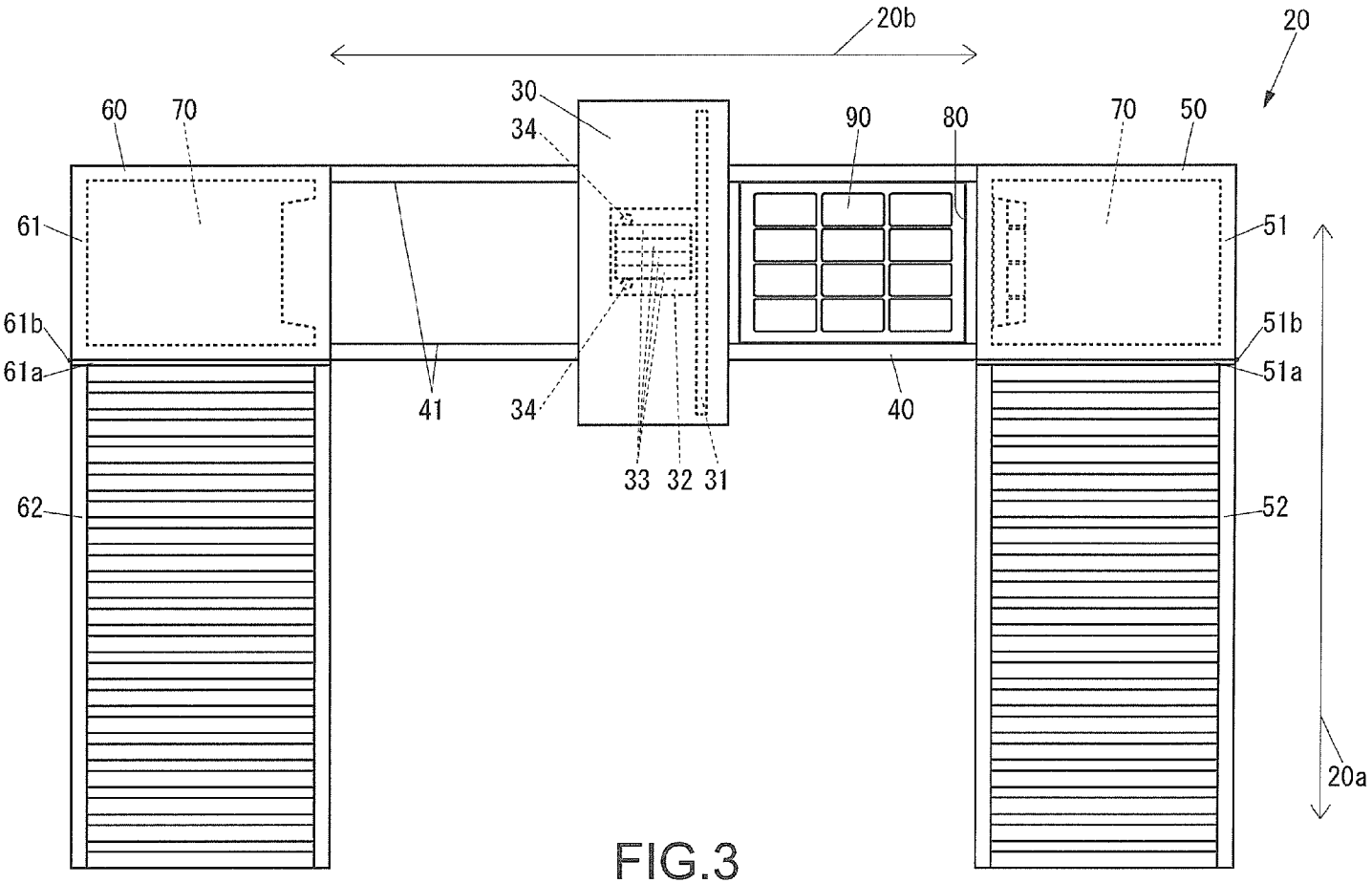
FIG. 3 is a plan view of the inkjet printer shown in FIG. 1 in the state shown in FIG. 2.

FIG. 2 is a front view of the inkjet printer 20 in a state where a pallet 80 is being transferred between a supply device 50 and a main body 30. FIG. 3 is a plan view of the inkjet printer 20 in the state shown in FIG. 2.

As shown in FIG. 2 and FIG. 3, the inkjet printer 20 includes a main body 30 extending in a main scanning direction shown by an arrow 20*a*, a transfer device 40 that transfers a pallet 80 that is a medium mounting stage of the present invention on which a plurality of workpieces 90 can be loaded, in a sub scanning direction shown by an arrow 20*b* that vertically intersects with the main scanning direction shown by the arrow 20*a*, the workpieces 90 being target media of the present invention that are targeted media for printing by the inkjet printer 20, a supply device 50 that supplies the pallet 80 to the transfer device 40, and a collecting device 60 that collects the pallet 80 from the transfer device 40.

The main body 30 is fixed to the transfer device 40. The main body 30 includes therein a guide rail 31 extending in the main scanning direction shown by the arrow 20*a*, and a carriage 32 supported on the guide rail 31 so as to be movable in the main scanning direction shown by the arrow 20*a*. The carriage 32 is equipped with a plurality of recording heads 33 for discharging ultraviolet curing type ink onto workpieces 90 in a direction shown by the arrow 20*c* that vertically intersects with both the main scanning direction shown by the arrow 20*a* and the sub scanning direction shown by the arrow 20*b*, and an ultraviolet irradiating device 34 such as a LED (Light Emitting Diode) for delivering ultraviolet ray for curing the ultraviolet curing type ink discharged by the recording heads 33 toward the workpieces 90.

The transfer device 40 has pallet guiding mechanisms 41 that can transfer the pallets 80 in the sub scanning direction shown by the arrow 20*b* provided on both sides in the main scanning direction shown by the arrow 20*a*.

The supply device 50 is connected to one end of the transfer device 40 in the sub scanning direction shown by the arrow 20*b*. The supply device 50 includes a lifting device 51 that can transfer a magazine 70 capable of storing a plurality of pallets 80 in the direction shown by the arrow 20*c*, and a roller conveyor 52 extending in the main scanning direction shown by the arrow 20*a* for taking the magazine 70 in and out of the lifting device 51. The lifting device 51 is provided with a door 51*a* that is opened when the magazine 70 is taken in and out, and a plurality of hinges 51*b* that supports the door 51*a* in an openable and closable manner.

The collecting device 60 is connected to an end portion on the opposite side from the supply device 50, among the end portions of the transfer device 40 in the sub scanning direction shown by the arrow 20*b*. The collecting device 60 includes a lifting device 61 that can transfer the magazine 70 in the direction shown by the arrow 20*c*, and a roller conveyor 62 extending in the main scanning direction shown by the arrow 20*a* for taking the magazine 70 in and out of the lifting device 61. The lifting device 61 includes a door 61*a* that is opened when the magazine 70 is taken in and out, and a plurality of hinges 61*b* that supports the door 61*a* in an openable and closable manner.

The transfer device 40, the supply device 50, and the collecting device 60 are configured to automatically replace the target pallet 80 for printing among the plurality of pallets 80 stored in the magazine 70, by operating in cooperation with each other, and configure a stage replacing device of the present invention.

Figure 4:
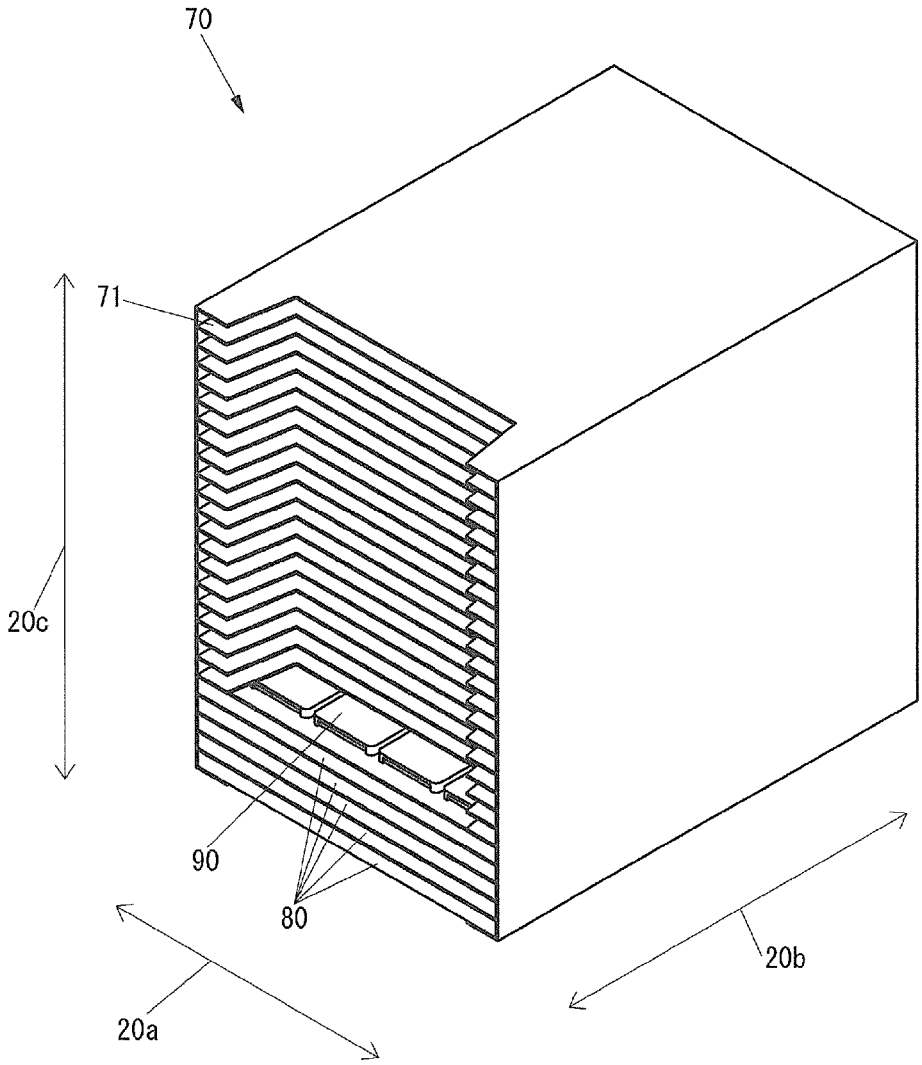
FIG. 4 is a perspective view of an outer appearance of a magazine used by the inkjet printer shown in FIG. 1.

FIG. 4 is an outer perspective view of the magazine 70.

As shown in FIG. 4, the magazine 70 has a plurality of storage portions 71 for storing the pallets 80 formed in the direction shown by the arrow 20*c*, and a plurality of pallets 80 can be stored therein.

Figure 5:
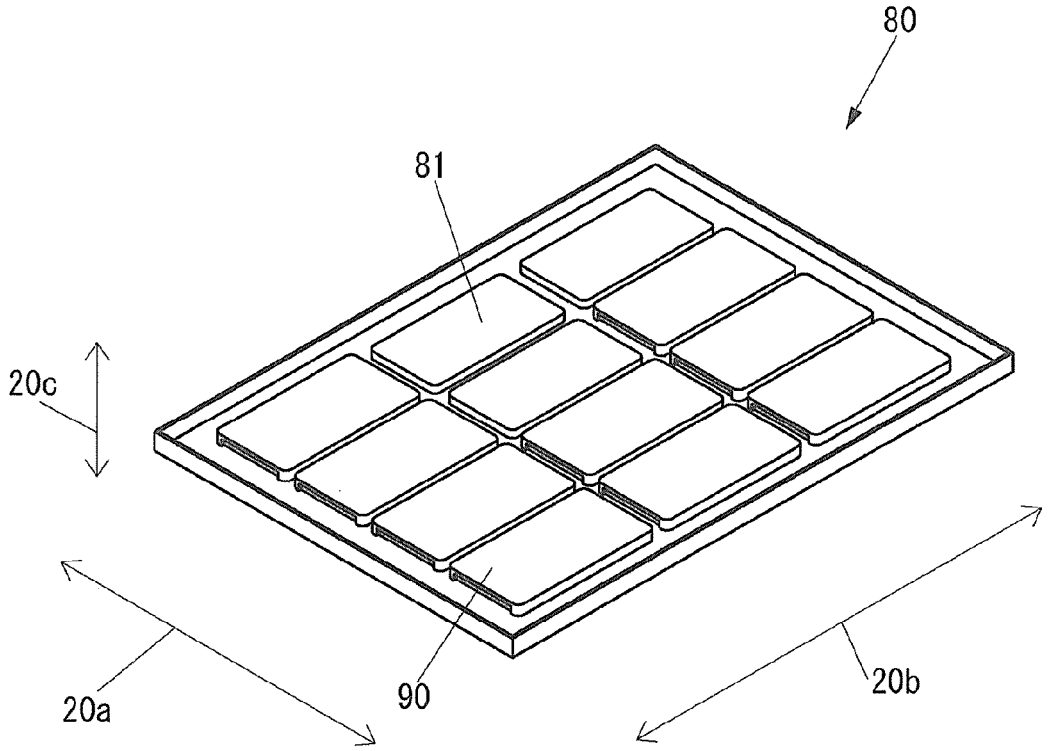
FIG. 5 is a perspective view of an outer appearance of a pallet shown in FIG. 4.

FIG. 5 is an outer perspective view of the pallet 80.

As shown in FIG. 5, a pallet 80 has a plurality of mounting portions 81 for mounting the workpieces 90 formed thereon, and is capable of mounting a plurality of workpieces 90. It should be noted that in the example shown in FIG. 5, the pallet 80 includes three rows of the mounting portions 81 in the main scanning direction shown by the arrow 20*a* and four rows of the mounting portions 81 in the sub scanning direction shown by the arrow 20*b*, and is capable of mounting a total of twelve workpieces 90.

The workpieces 90 may for example be covers for a portable terminal such as a smart phone.

Figure 6:
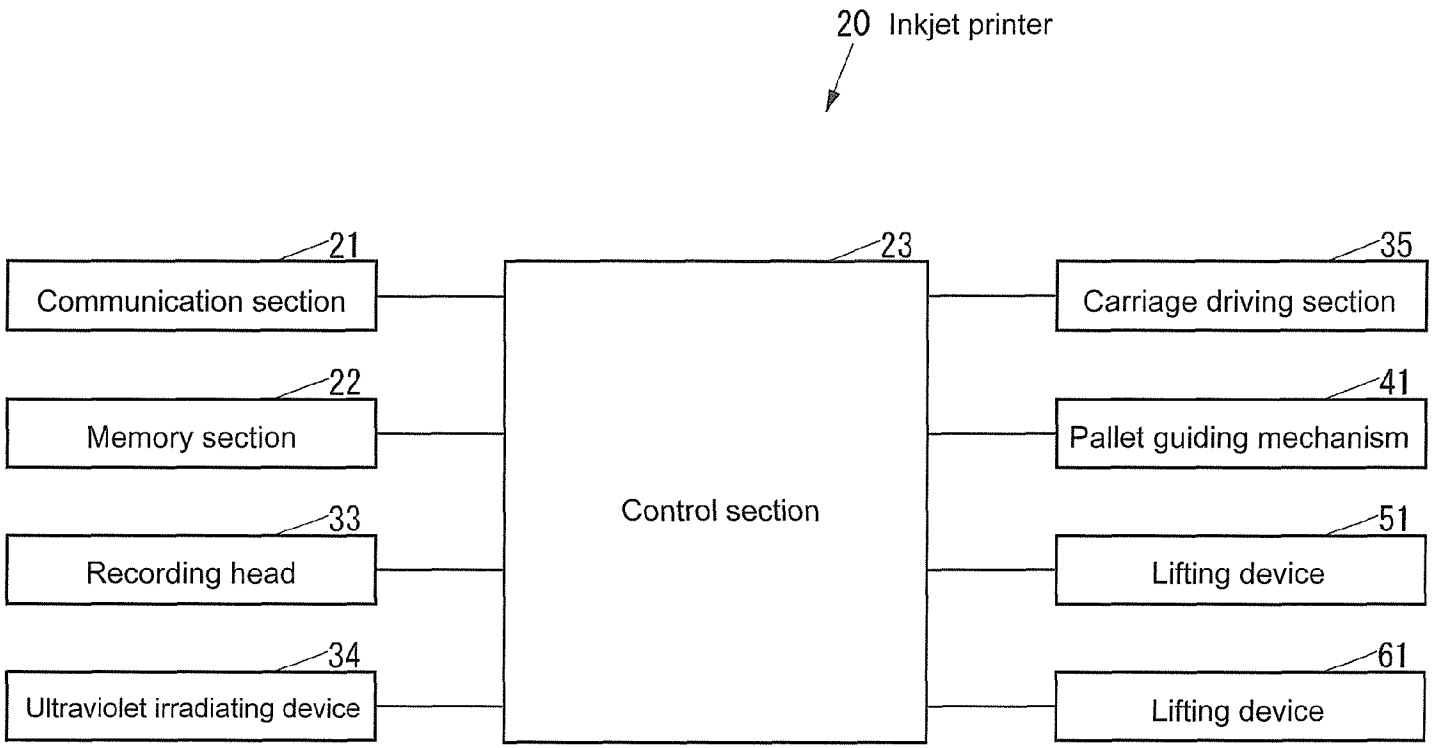
FIG. 6 is a block diagram of the inkjet printer shown in FIG. 1.

FIG. 6 is a block diagram of the inkjet printer 20.

As shown in FIG. 6, the inkjet printer 20 includes the aforementioned recording heads 33 and ultraviolet irradiating device 34, a carriage driving section 35 that causes the carriage 32 (see FIG. 3) to move in the main scanning direction shown by the arrow 20*a* (see FIG. 3) relative to the guide rail 31 (see FIG. 3), the aforementioned pallet guiding mechanisms 41, lifting device 51, and lifting device 61, a communication section 21 that is a communication device for performing communication with external devices such as a computer 100 (see FIG. 1) via the cable 11 (see FIG. 1) or a network, a memory section 22 that is a memory device such as an EEPROM (Electrically Erasable Programmable Read Only Memory) storing various types of data, and a control section 23 that controls an entirety of the inkjet printer 20.

Here, the carriage driving section 35 is a device that relatively moves the recording heads 33 in the main scanning direction shown by the arrow 20*a* relative to the pallet 80 (see FIG. 5) supported on the pallet guiding mechanisms 41, by moving the carriage 32 equipped with the recording heads 33 in the main scanning direction shown by the arrow 20*a* relative to the guide rail 31. Further, the pallet guiding mechanisms 41 are a device that relatively moves the recording heads 33 in the sub scanning direction shown by the arrow 20*b* relative to the pallet 80 supported on the pallet guiding mechanisms 41 by moving the pallet 80 in the sub scanning direction shown by the arrow 20*b* (see FIG. 3) relative to the main body 30 provided with the recording heads 33. Accordingly, the carriage driving section 35 and the pallet guiding mechanisms 41 configure the relative movement device of the present invention that relatively moves the recording heads 33 in the main scanning direction shown by the arrow 20*a* and the sub scanning direction shown by the arrow 20*b* relative to the pallet 80.

The control section 23 includes, for example, a CPU (Central Processing Unit), a ROM (Read Only Memory) that stores programs and various types of data in advance, and a RAM (Random Access Memory) used as a work area for the CPU. The CPU is configured to execute the programs stored in the ROM or the memory section 22.

Figure 7:
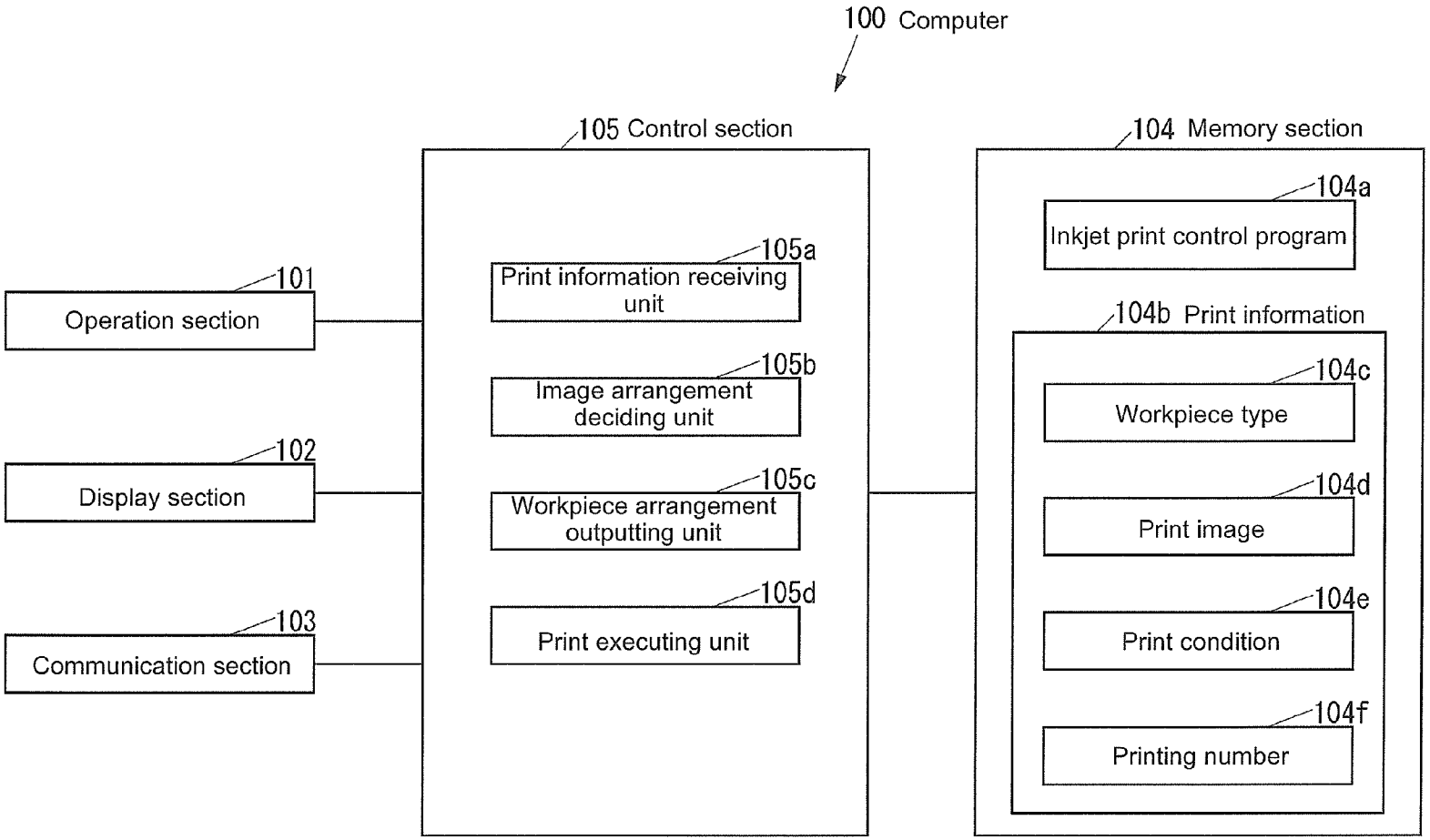
FIG. 7 is a block diagram of a computer shown in FIG. 1.

FIG. 7 is a block diagram of the computer 100.

As shown in FIG. 7, the computer 100 is configured of an operation section 101 that is an input device such as a mouse or a keyboard with which various operations are inputted, a display section 102 as an information output section of the present invention, being a display device such as an LCD (Liquid Crystal Display) for displaying various types of information, a communication section 103 that is a communication device for performing communication with external devices such as the inkjet printer 20 (see FIG. 1) via the cable 11 (see FIG. 1) or the network, a memory section 104 that is a memory device such as an HDD (Hard Disk Drive) storing programs and various types of data, and a control section 105 that controls an entirety of the computer 100. The computer 100 is configured, for example, of a computer such as a PC (Personal Computer).

The memory section 104 stores an inkjet print control program 104*a* that is a program for controlling printing by the inkjet printer 20. The inkjet print control program 104*a* may be installed in the computer 100 in a manufacturing process of the computer 100, may be additionally installed to the computer 100 from a storage medium such as a CD (Compact Disk) or a DVD (Digital Versatile Disk), or may be additionally installed to the computer 100 from the network.

The memory section 104 can store a plurality of print information 104*b*, each of which is information used for printing by the inkjet printer 20. The print information 104*b* is information including a workpiece type 104*c* as a medium type of the present invention, which is a type of a workpiece 90, a print image 104*d* that is an image to be printed on the workpiece 90, a print condition 104*e* for the print image 104*d*, and a printing number 104*f* that is the number of printing of the print image 104*d*.

The workpiece type 104*c* is, for example, a type specified by color, size, and shape of the workpiece 90.

The print condition 104*e* includes, for example, a resolution upon printing the print image 104*d*, a pass number for printing the print image 104*d*, presence/absence of a base by white ink (hereafter referred to as "white base") upon printing the print image 104*d*, and the number of coating by translucent ink (hereafter referred to as "clear coating") upon printing the print image 104*d*.

When an image arrangement is set in a state where a plurality of print images 104*d* with different resolutions is aligned in the main scanning direction shown by the arrow 20*a*, the inkjet printer 20 is configured to perform series of printing operations (hereafter referred to as "one-series of printing operation") independently for the plurality of print images 104*d* aligned in the main scanning direction shown by the arrow 20*a* in units of different print conditions, namely the difference in resolution, where the one-series of printing operation is performed by repeating an ink discharge in the main scanning direction shown by the arrow 20*a* that discharges the ink onto the workpieces 90 on the pallet 80 by the recording heads 33 while relatively moving the recording heads 33 in the main scanning direction shown by the arrow 20*a* relative to the pallet 80, and a relative movement of the recording heads 33 in the sub scanning direction shown by the arrow 20*b* relative to the pallet 80.

Printings by different pass numbers cannot be performed simultaneously. Accordingly, if the image arrangement is set in a state where a plurality of print images 104*d* with different pass numbers is aligned in the main scanning direction shown by the arrow 20*a*, the inkjet printer 20 needs to perform the one-series of printing operation in the units of different print conditions, namely the difference in pass numbers, for the plurality of print images 104*d* aligned in the main scanning direction shown by the arrow 20*a*.

The white base can cause colors in the print images 104*d* to be printed on the white base to be brightly standing out. The white base printing needs to be performed prior to the printing of the print images 104*d* on the white base. Accordingly, if the image arrangement is set in a state where the printing images 104*d* in need of the white base and the printing images 104*d* not needing the white base are aligned in the main scanning direction shown by the arrow 20*a*, the inkjet printer 20 is configured to perform the one-series of printing operation independently in the units of different print conditions, namely the presence/absence of the white base, for the plurality of print images 104*d* aligned in the main scanning direction shown by the arrow 20*a*.

The clear coating can improve design and strength of the print images 104*d* to be printed under the clear coating. Further, the clear coating can form the number of layers according to the number of times that the printing takes place, as a result of which a thickness corresponding to the number of times that the printing takes place can be formed. The printing of the clear coating needs to be performed after the printing of the print images 104*d* under the clear coating. Further, the printing of the clear coating needs to be performed independently for each layer of the clear coating. Accordingly, if the image arrangement is set in a state where a plurality of printing images 104*d* with different numbers of clear coating is aligned in the main scanning direction shown by the arrow

20*a*, the inkjet printer 20 is configured to perform the one-series of printing operation independently in the units of different print conditions, namely the difference in number of clear coating, for the plurality of print images 104*d* aligned in the main scanning direction shown by the arrow 20*a*.

The control section 105 includes, for example, a CPU, a ROM storing programs and various types of data in advance, and a RAM used as a work area for the CPU. The CPU is configured to execute programs stored in the ROM or the memory section 104.

The control section 105 functions as a print information receiving unit 105*a* that receives print information 104*b* by executing the inkjet print control program 104*a* stored in the memory section 104, an image arrangement deciding unit 105*b* that decides the image arrangement on the pallet 80 of the print images 104*d* included in the print information 104*b* received by the print information receiving unit 105*a*, a workpiece arrangement outputting unit 105*c* as a medium arrangement outputting unit of the present invention that outputs the workpiece arrangement as the medium arrangement of the present invention, which is an arrangement of the workpieces 90 according to the image arrangement decided by the image arrangement deciding unit 105*b*, to the display section 102, and a print executing unit 105*d* that executes printing on the workpieces 90 on the pallet 80 by the recording heads 33, the carriage driving section 35, and the pallet guiding mechanisms 41.

Next, an operation of the inkjet printing system 10 will be described.

Firstly, an outline of the operation of the inkjet printing system 10 will be described.

Figure 8:
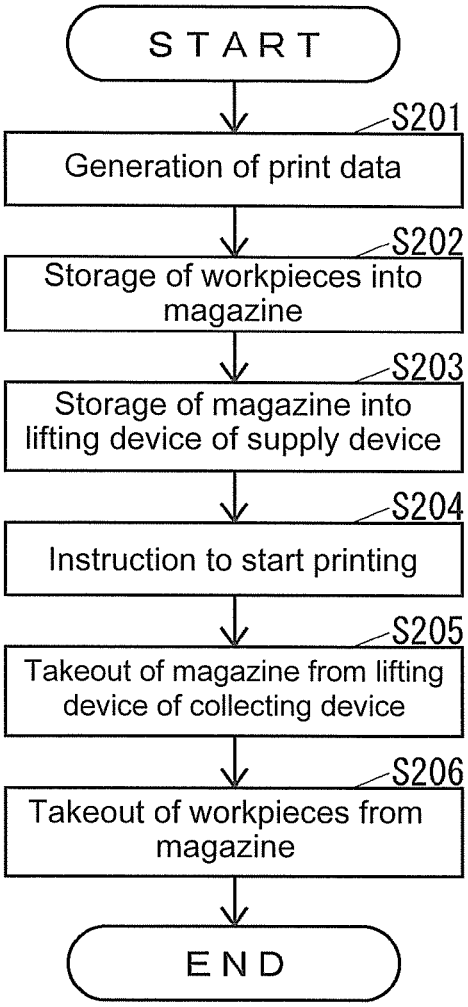
FIG. 8 is a flow chart of a work procedure by a user of the inkjet printing system shown in FIG. 1.

FIG. 8 is a flow chart of a work procedure by a user of the inkjet printing system 10.

As shown in FIG. 8, the user inputs the print information 104*b* to the computer 100 via the operation section 101 of the computer 100, so that the computer 100 generates print data (S201). Here, the print information receiving unit 105*a* of the control section 105 of the computer 100 to which the print information 104*b* has been inputted receives the inputted print information 104*b*. Further, the image arrangement deciding unit 105*b* of the control section 105 decides the image arrangement based on the print information 104*b* received by the print information receiving unit 105*a*. Then, the workpiece arrangement outputting unit 105*c* of the control section 105 causes the image arrangement decided by the image arrangement deciding unit 105*b* to be displayed on the display section 102. Further, the print executing unit 105*d* of the control section 105 generates the print data based on the print images 104*d* and print conditions 104*e* included in the print information 104*b* received by the print information receiving unit 105*a* and the image arrangement decided by the image arrangement deciding unit 105*b*.

Figure 9:
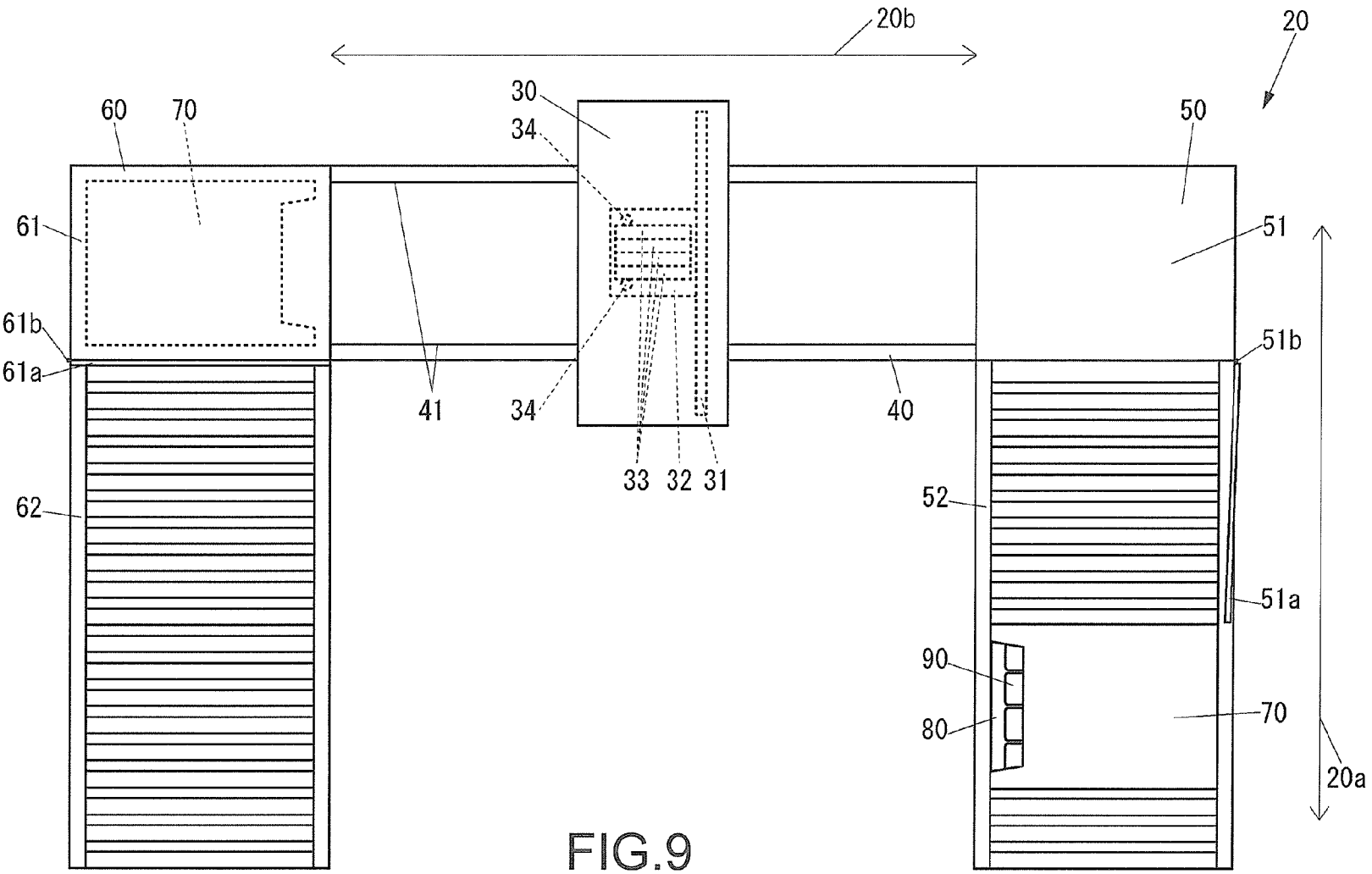
FIG. 9 is a plan view of the inkjet printer shown in FIG. 1 in a state where the magazine is mounted on a roller conveyor of the supply device.

FIG. 9 is a plan view of the inkjet printer 20 in a state where the magazine 70 is mounted on the roller conveyor 52 of the supply device 50.

After the work in S201, the user loads the workpieces 90 on the pallet 80 so that positions of the workpieces 90 on the pallet 80 in the magazine 70 match the workpiece arrangement displayed on the display section 102 of the computer 100, and stores the pallet 80 in the magazine 70 mounted on the roller conveyor 52 as shown in FIG. 9 (S202).

Figure 10:
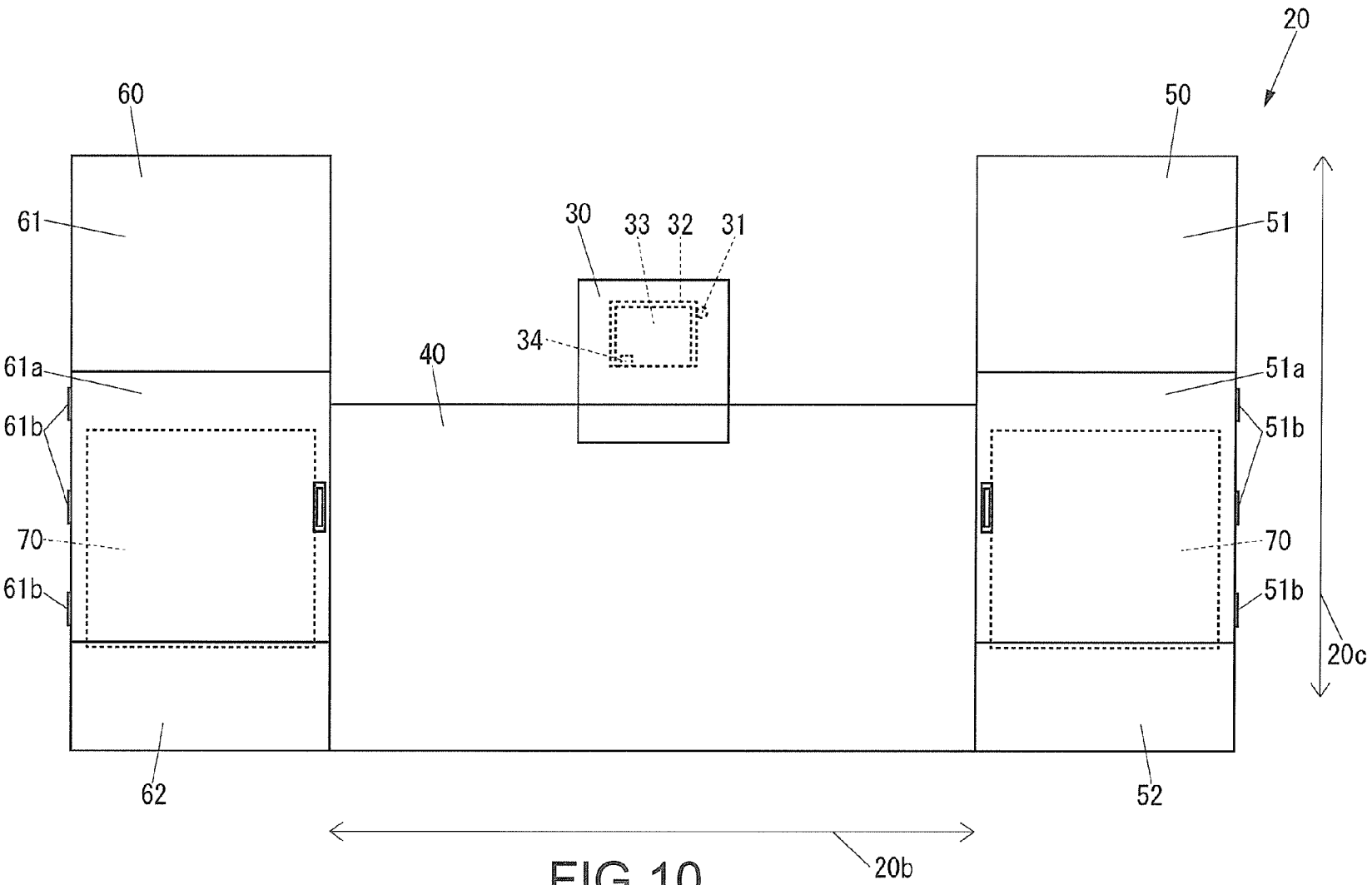
FIG. 10 is a front view of the inkjet printer shown in FIG. 1 in a state where the magazine is positioned at a lowest position in a lifting device of the supply device.

FIG. 10 is a front view of the inkjet printer 20 in a state where the magazine 70 is positioned at a lowest position in the lifting device 51 of the supply device 50.

After the work in S202, the user stores the magazine 70 mounted on the roller conveyor 52 in the lifting device 51 of the supply device 50 as shown in FIG. 10 (S203).

After the work in S203, the user instructs the computer 100 to start printing via the operation section 101 of the computer 100 (S204). The print executing unit 105*d* of the control section 105 of the computer 100 to which the start of the printing has been instructed sends the print data generated in S201 to the inkjet printer 20 via the communication section 103. The control section 23 of the inkjet printer 20 that has received the print data via the communication section 21 executes printing on the workpieces 90 based on this print data.

Firstly, the control section 23 controls the lifting device 51 of the supply device 50 and the lifting device 61 of the collecting device 60 based on the print data to align a height of a first pallet 80 in the magazine 70 in the lifting device 51 to be level with a height of the pallet guiding mechanisms 41 of the transfer device 40, in the direction shown by the arrow 20*c*, and further aligns a height of the magazine 70 in the lifting device 61 to be level with a height of the magazine 70 in the lifting device 51 in the direction shown by the arrow 20*c*.

Next, the control section 23 controls the pallet guiding mechanisms 41 of the transfer device 40 based on the print data to take out the pallet 80 by the pallet guiding mechanisms 41 from the magazine 70 in the lifting device 51 of the supply device 50 as shown in FIG. 2 and FIG. 3.

Figure 11:
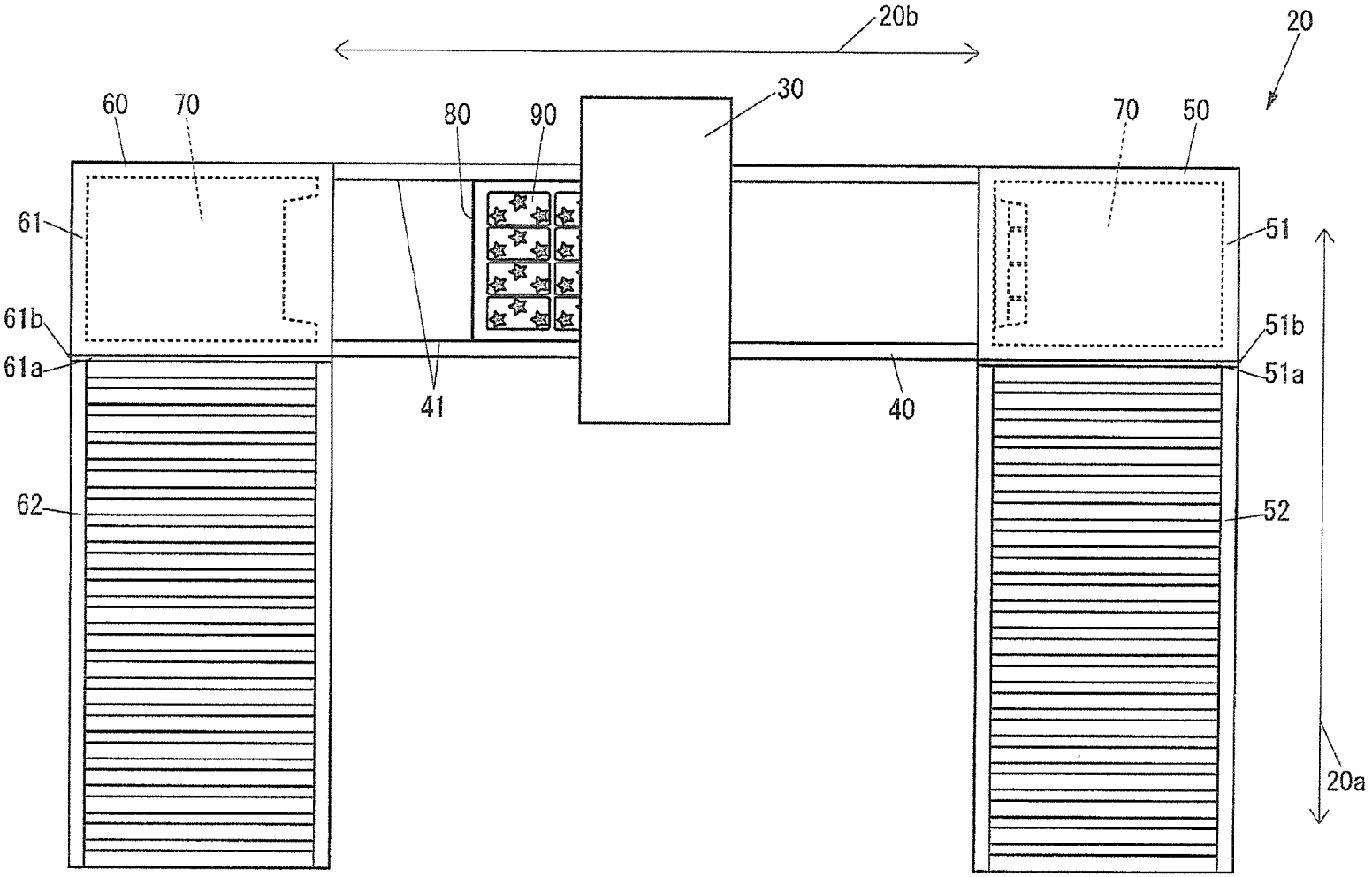
FIG. 11 is a plan view of the inkjet printer shown in FIG. 1 in a state where the pallet is being transferred between the main body and a collecting device.

FIG. 11 is a plan view of the inkjet printer 20 in a state where the pallet 80 is being transferred between the main body 30 and the collecting device 60.

After having taken out the pallet 80 from the magazine 70 in the lifting device 51, the control section 23 prints print images included in the print data on the workpieces 90 loaded on the pallet 80 as shown in FIG. 11, by controlling the recording heads 33, the ultraviolet irradiating device 34, and the carriage driving section 35 of the main body 30, and the pallet guiding mechanisms 41 of the transfer device 40 based on the print data.

Next, after having printed the print images on the workpieces 90 loaded on the pallet 80, the control section 23 controls the pallet guiding mechanisms 41 of the transfer device 40 based on the print data to store the pallet 80 in the magazine 70 in the lifting device 61 of the collecting device 60 by the pallet guiding mechanisms 41.

If some pallets 80 being the print targets still remain in the magazine 70 in the lifting device 51, the control section 23 controls the lifting device 51 of the supply device 50 and the lifting device 61 of the collecting device 60 based on the print data to align a height of a subsequent pallet 80 in the magazine 70 in the lifting device 51 to be level with the height of the pallet guiding mechanisms 41 of the transfer device 40 in the direction shown by the arrow 20*c*, and further aligns the height of the magazine 70 in the lifting device 61 to be level with the height of the magazine 70 in the lifting device 51 in the direction shown by the arrow 20*c*. Further, the control section 23 performs the printing as described above on the pallet 80 aligned with the height of the pallet guiding mechanisms 41 of the transfer device 40, among the pallets 80 stored in the magazine 70 in the lifting device 51, and stores the same in the magazine 70 in the lifting device 61. If some pallets 80 being the print targets still remain in the magazine 70 in the lifting device 51, the control section 23 repeats the above series of processes until when the pallets 80 being the print targets no longer remains in the magazine 70 in the lifting device 51.

When the printing on all of the workpieces 90 on the pallet 80 being the print targets is finished, the control section 23 controls the lifting device 51 of the supply device 50 and the lifting device 61 of the collecting device 60 as shown in FIG.

10 so that the magazine 70 in the lifting device 51 of the supply device 50 and the magazine 70 in the lifting device 61 of the collecting device 60 are moved to the lowermost positions, and the printing on the workpieces 90 based on the print data is ended.

It should be noted that after having started the printing in S204, the control section 23 sends a progress of the printing, such as a type of the workpieces 90, contents of the printing of the print image, and how many out of a total number thereof has been completed so far, to the computer 100 via the communication section 21. The print executing unit 105*d* of the control section 105 of the computer 100 that has received this progress via the communication section 103 displays the progress on the display section 102. Accordingly, the user can grasp the progress of the printing by the inkjet printer 20 by the display on the display section 102.

Figure 12:
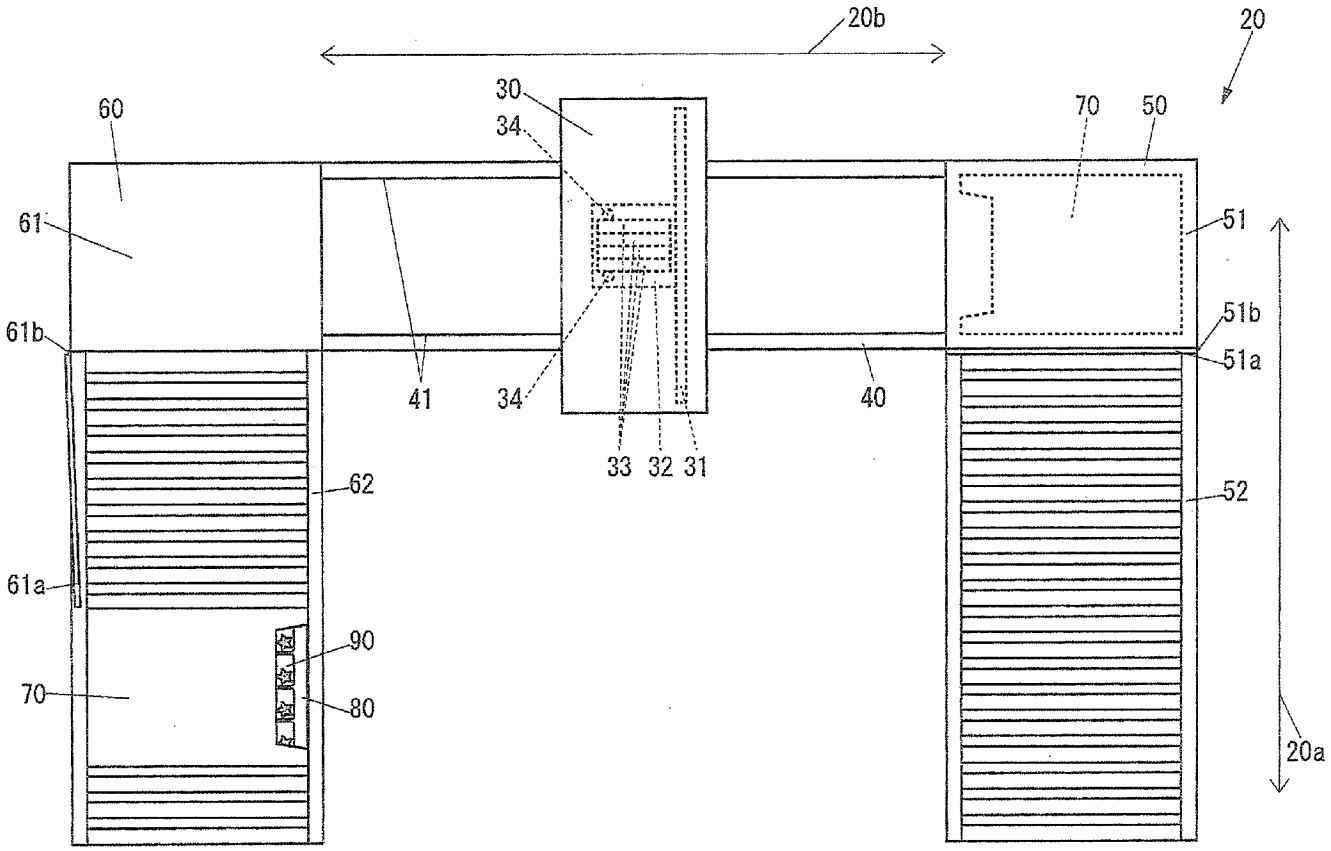
FIG. 12 is a plan view of the inkjet printer shown in FIG. 1 in a state where the magazine is mounted on a roller conveyor of the collecting device.

FIG. 12 is a plan view of the inkjet printer 20 in a state where the magazine 70 is mounted on the roller conveyor 62 of the collecting device 60.

As shown in FIG. 8, when the printing by the inkjet printer 20 is finished, the user takes out the magazine 70 stored in the lifting device 61 of the collecting device 60 onto the roller conveyor 62 as shown in FIG. 12 (S205).

Next, the user collects the printed workpieces 90 from the pallet 80 in the magazine 70 taken out onto the roller conveyor 62 (S206), and ends the series of work shown in FIG. 8.

As described above, the inkjet printing system 10 can automatically perform printing on a large quantity of workpieces 90, so that user's burden can be reduced greatly compared to a configuration in which the user replaces the pallets 80 one by one manually, and in addition the time required for completing the printing on all of the workpieces 90 can be reduced greatly. Accordingly, for example, the user can have the printing onto the workpieces 90 performed by the inkjet printer 20 in an unattended manner during the night, by performing the work of S201 to S204 in the evening, and then perform the work of S205 and S206 in the next morning.

In the above, an example in which the inkjet printer 20 has completed printing based only on the print data generated by the computer 100 in S201 is described. However, with the inkjet printing system 10, new print data may be added after the inkjet printer 20 has started printing and before the printing is finished.

That is, when the user issues an instruction to add the new print data to the computer 100 via the operation section 101 of the computer 100, the print executing unit 105*d* of the control section 105 of the computer 100 instructs the inkjet printer 20 to temporarily stop the currently executing printing at the time when the printing on the pallet 80 that the inkjet printer 20 is currently aiming as the print target is finished. Further, when the printing by the inkjet printer 20 is temporarily stopped, the user takes out the magazine 70 in the lifting device 51 of the supply device 50 onto the roller conveyor 52 of the supply device 50, and thereafter causes the computer 100 to generate new print data similar to the work in S201 by inputting a new print information 104*b* in the computer 100 via the operation section 101 of the computer 100. Next, the user loads the workpieces 90 for the new print data on the pallet 80 according to the workpiece arrangement displayed on the display section 102 of the computer 100 similar to the work in S202, and stores this pallet 80 in the magazine 70. Next, the user stores the magazine 70 in the lifting device 51 of the supply device 50, similar to the work in S203. Then, the user instructs the computer 100 to restart the printing via the operation section 101 of the computer 100. The print executing unit 105*d* of the control section 105 of the computer 100 to which the restart of printing has been instructed sends the new print data that has been generated to the inkjet printer 20 via the communication section 103. The control section 23 of the inkjet printer 20 that has received this print data via the communication section 21 restarts the printing onto the workpieces 90 based on the print data to which the new print data has been added.

It should be noted that as a method for adding the new print data, the user can instruct the computer 100 to add the same to the head of the print data before the addition, or to the end thereof, via the operation section 101 of the computer 100.

For example, the significance of adding the new print data to the head of the print data before the addition is great in a case where a printing on a different workpiece 90 suddenly becomes necessary when printing on a large quantity of workpieces 90 is being performed, such as a case where the printing that is being executed requires time of a few hours or more.

Further, for example, if the printing is started after having loaded all of the workpieces 90 on the pallets 80 and having stored the same in the magazine 70 in the case of executing printing on a large quantity of workpieces 90, a long time is required for loading all of the workpieces 90 on the pallets 80 and storing the same in the magazine 70, whereby the start of the printing is delayed, and as a result, a long time is required for the printing on all of the workpieces 90 to be finished. However, if printing is performed by sequentially adding the pallet 80 to which the load of the workpieces 90 has been completed while performing the printing by the inkjet printer 20 on the pallets 80 onto which the load of the workpieces 90 has been completed and the work to load the subsequent workpieces 90 onto the pallets 80 in parallel, the time required for the printing on all of the workpieces 90 to be finished can be shortened. Accordingly, the significance of adding the new print data to the end of the print data before the addition is also great.

Next, an operation of the computer 100 in the case where the print information 104*b* is inputted will be described in detail.

Figure 13:
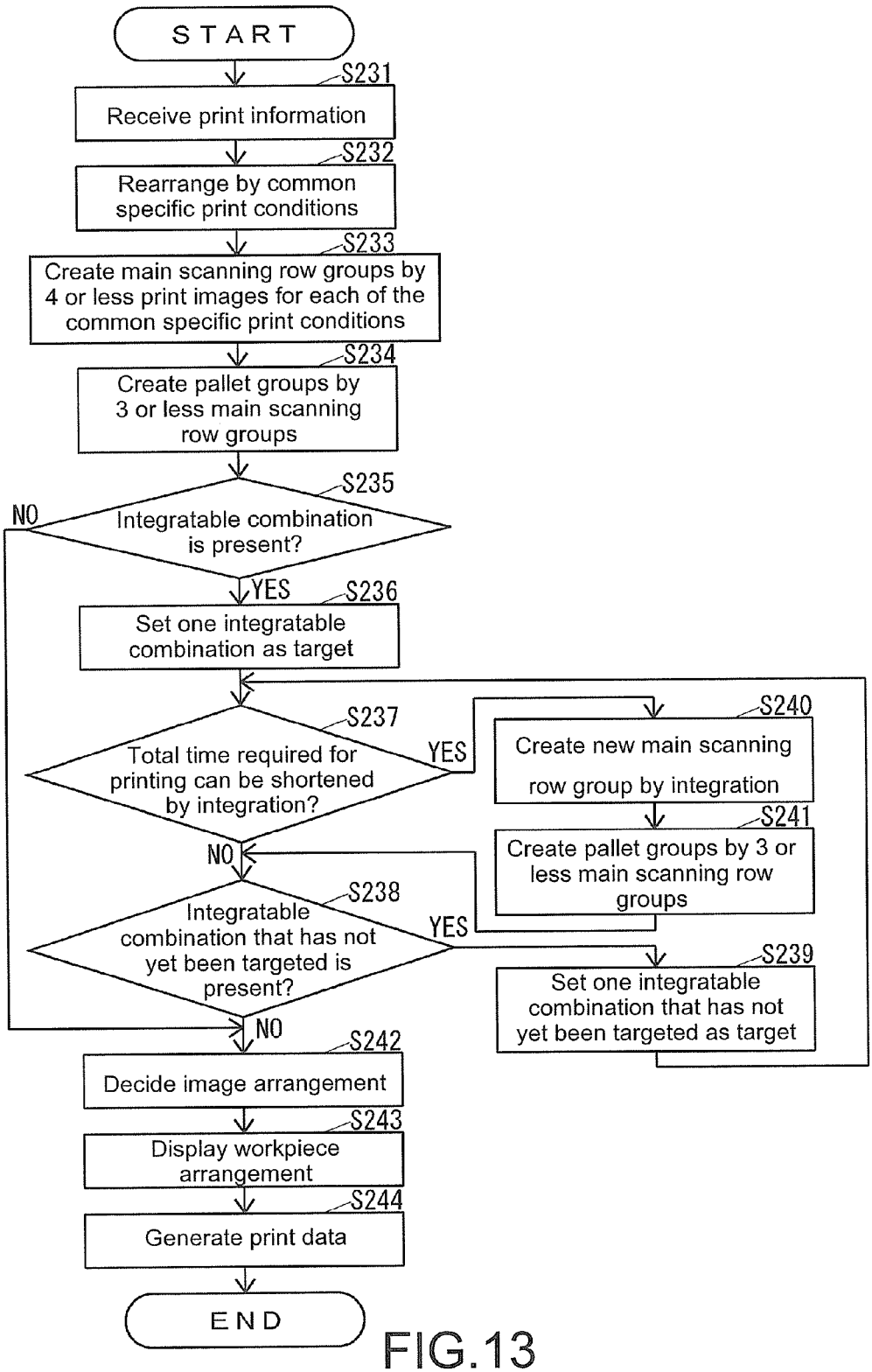
FIG. 13 is a flowchart of an operation of the computer shown in FIG. 1 in a case where print information is inputted.

FIG. 13 is a flowchart of an operation of the computer 100 in a case where the print information 104*b* is inputted.

The control section 105 of the computer 100 starts the operation shown in FIG. 13 when the input of the print information 104*b* is instructed via the operation section 101.

As shown in FIG. 13, the print information receiving unit 105*a* of the control section 105 receives the print information 104*b* inputted via the operation section 101 (S231). It should be noted that in the case of receiving the print condition 104*e* of the print information 104*b*, the print information receiving unit 105*a* not only receives the print condition 104*e* directly inputted via the operation section 101 but also may be configured to receive the print condition 104*e* that is predeterminedly associated with the workpiece type 104*c* that is inputted via the operation section 101. For example, in a case where the color of the workpiece 90 that is specified by the workpiece type 104*c* inputted via the operation section 101 is a color other than white, the print information receiving unit 105*a* may automatically add a white base as the print condition 104*e*.

Next, the image arrangement deciding unit 105*b* of the control section 105 rearranges the print images 104*d* received in S231 by common specific print condition (S232). Here, in the present embodiment, the specific print condition refers to four conditions among the print condition 104*e*, namely the resolution, pass number, presence/absence of white base, and the number of clear coating.

FIG. 14 is a diagram showing an example of the print information 104*b* received by the print information receiving unit 105*a*. FIG. 15 is a diagram showing information in which print images 104*d* in the print information 104*b* shown in FIG. 14 are independently separated, and ID is given to each of the print images 104*d*. FIG. 16 is a diagram showing information that the information shown in FIG. 15 is rearranged by common specific print condition.

Explanation will be given on a case where the print information 104*b* received in S231 is information shown in FIG. 14. Hereinbelow, information shown in FIG. 14 will not be grouped by their printing number 104*f*, but instead divided separately for each print image 104*d*, and the explanation will be given by using the information shown in FIG. 15 to which ID is given to each of the print images 104*d*. If the print information 104*b* received in S231 is the information shown in FIG. 14, the information shown in FIG. 15 is rearranged by common specific print condition in S232, and is formed into information shown in FIG. 16.

As shown in FIG. 13, after the process of S232, the image arrangement deciding unit 105*b* creates a group (hereafter referred to as "main scanning row group") of the print images 104*d* for the workpieces 90 arranged in the same row, among the rows in the main scanning direction shown by the arrow 20*a* in the pallet 80, by grouping the print images 104*d* received in S231 in a largest possible number that is four or less for each of the common specific print conditions (S233). Here, four pieces, which is a number that is the reference for the creation of the main scanning row groups in S233, correspond to the number of workpieces 90 that can be loaded in the main scanning direction shown by the arrow 20*a* on the pallet 80. Accordingly, in a case where the number of the workpieces 90 that can be loaded in the main scanning direction shown by the arrow 20*a* on the pallet 80 is a number other than four pieces, the number that is the reference for the creation of the main scanning row groups in S233 matches the number of the workpieces 90 that can be loaded in the main scanning direction shown by the arrow 20*a* on the pallet 80.

Next, the image arrangement deciding unit 105*b* creates a group (hereafter referred to as "pallet group") of print images 104*d* for the workpieces 90 arranged in the same pallet 80 by grouping the main scanning row groups created in S233 by a largest possible number that is three or less (S234). Here, three pieces, which is a number that is the reference for the creation of the pallet groups in S234, correspond to the number of workpieces 90 that can be loaded in the sub scanning direction shown by the arrow 20*b* on the pallet 80. Accordingly, in a case where the number of the workpieces 90 that can be loaded in the sub scanning direction shown by the arrow 20*b* on the pallet 80 is a number other than three pieces, the number that is the reference for the creation of the pallet groups in S234 matches the number of the workpieces 90 that can be loaded in the sub scanning direction shown by the arrow 20*b* on the pallet 80.

FIG. 17 is a diagram showing information that the information shown in FIG. 16 is divided by pallet group and main scanning row group.

In the case where the information that was rearranged in S232 is the information shown in FIG. 16, the information shown in FIG. 16 is divided into the main scanning row groups in S233, and thereafter divided into pallet groups in S234, and is formed into information shown in FIG. 17.

It should be noted that in the information shown in FIG. 17, the pallet groups are identified by pallet numbers. The pallet numbers are allotted such that "1" is given to the pallet 80 stored in the lowermost storage portion 71 of the magazine 70, and they are given so as to increment by 1 from the pallet 80 stored in the lowermost storage portion 71 toward the pallet 80 stored in the uppermost storage portion 71. Further, each of the main scanning row groups is identified by a combination of the pallet number and a main scanning row number. The main scanning row numbers are allotted such that "1" is given to the foremost row among the rows in the main scanning direction shown by the arrow 20*a* of the pallet 80, relative to an opening of the storage portion 71 in a state where the pallet 80 is stored in the storage portion 71 of the magazine 70, and they are given so as to increment by 1 from the foremost row relative to the opening of the storage portion 71 toward the rearmost row. Further, a group (hereafter referred to as "sub scanning row group") of print images 104*d* for the workpieces 90 arranged in the same row among the rows in the sub scanning direction shown by the arrow 20*b* in the pallet 80 is identified by a combination of the pallet number and a sub scanning row number. The sub scanning row numbers are allotted such that "1" is given to the rightmost row among the rows in the sub scanning direction shown by the arrow 20*b* of the pallet 80, relative to the opening of the storage portion 71 in a state where the pallet 80 is stored in the storage portion 71 of the magazine 70, and they are given so as to increment by 1 from the rightmost row relative to the opening of the storage portion 71 toward the leftmost row.

As shown in FIG. 13, the image arrangement deciding unit 105*b* determines whether or not there is a combination (hereafter referred to as "integratable combination") of a plurality of main scanning row groups with the number of print images 104*d* remaining to be 4 or less after the process of S234, despite being integrated (S235). Here, four pieces, which is a number that is the reference for the integratable combination in S235, correspond to the number of workpieces 90 that can be loaded in the main scanning direction shown by the arrow 20*a* on the pallet 80. Accordingly, in a case where the number of the workpieces 90 that can be loaded in the main scanning direction shown by the arrow 20*a* on the pallet 80 is a number other than four pieces, the number that is the reference for the integratable combination in S235 matches the number of the workpieces 90 that can be loaded in the main scanning direction shown by the arrow 20*a* on the pallet 80.

In determining that there is an integratable combination in S235, the image arrangement deciding unit 105*b* sets one integratable combination as a target (S236).

The image arrangement deciding unit 105*b* determines whether or not a total time required for printing can be shortened if a new main scanning row group is supposedly created by integrating the plurality of main scanning row groups configuring the integratable combination that is being the current target (S237). Here, the time required for printing on each pallet 80 can be calculated, for example, based on predetermined performances of the recording heads 33, the carriage driving section 35, and the pallet guiding mechanisms 41, and the combination of the print images 104*d* and the print conditions 104*e*. Further, the time required for the replacement of the pallet 80 can be calculated, for example, based on predetermined performances of the transfer device 40, the supply device 50, and the collecting device 60. Further, the total time required for the printing can be calculated, for example, based on the time required for the printing on each pallet 80 and the time required for the replacement of the pallets 80.

In determining that the total time required for the printing cannot be shortened in S237, the image arrangement deciding unit 105*b* determines whether or not there is an integratable combination that has not yet been the target (S238).

In determining in S238 that there is an integratable combination that has not yet been the target, the image arrangement deciding unit 105*b* sets one integratable combination that has not yet been the target as the target (S239), and returns again to the process of S237.

In determining that the total time required for the printing can be shortened in S237, the image arrangement deciding unit 105*b* integrates the plurality of main scanning row groups configuring the integratable combination being the current target to create a new main scanning row group (S240).

Next, the image arrangement deciding unit 105*b* creates the pallet groups by three or less main scanning row groups by regrouping all of the main scanning row groups, including the main scanning row group created in S240, by a largest possible number that is three or less (S241), and performs the process of S238. Here, three pieces, which is a number that is the reference for the creation of the pallet groups in S241, correspond to the number of workpieces 90 that can be loaded in the sub scanning direction shown by the arrow 20*b* on the pallet 80. Accordingly, in a case where the number of the workpieces 90 that can be loaded in the sub scanning direction shown by the arrow 20*b* on the pallet 80 is a number other than three pieces, the number that is the reference for the creation of the pallet groups in S241 matches the number of the workpieces 90 that can be loaded in the sub scanning direction shown by the arrow 20*b* on the pallet 80.

FIG. 18 is a diagram showing information that the information shown in FIG. 17 is divided by new pallet group and main scanning row group.

In the case where the information that has been divided into the main scanning row groups and pallet groups in S233 and S234 is the information shown in FIG. 17, the information shown in FIG. 17 is divided into the new main scanning row groups in S240, and thereafter divided into new pallet groups in S241, and is formed into information shown in FIG. 18. Here, in the information shown in FIG. 18 as compared to the information shown in FIG. 17, for example, the pallet group and main scanning row group of the print images 104*d* with a print ID "011" are changed, and the main scanning row group of the print image 104*d* with the print ID "012" is changed.

As shown in FIG. 13, in determining that there is no integratable combination in S235 or determining that there is no integratable combination that has not yet been the target in S238, the image arrangement deciding unit 105*b* decides the arrangement according to the pallet numbers, main scanning row numbers and sub scanning row numbers given to the print images 104*d* at that time as the image arrangement that is the arrangement of the print images 104*d* on the pallet 80 (S242).

Then, the workpiece arrangement outputting unit 105*c* of the control section 105 causes the workpiece arrangement according to the image arrangement decided in S242 to be displayed on the display section 102 (S243).

FIG. 19 is a diagram showing information on the workpiece arrangement generated based on the information shown in FIG. 18.

In a case where the information of which image arrangement has been decided in S242 is the information shown in FIG. 18, the information on the workpiece arrangement displayed on the display section 102 in S243 comes to be information shown in FIG. 19. Accordingly, the user simply needs to load the workpieces 90 on the pallets 80 and store the pallets 80 in the magazine 70 mounted on the roller conveyor 52 so that the positions of the workpieces 90 on the pallets 80 in the magazine 70 match the workpiece arrangement shown in FIG. 19.

The workpiece arrangement outputting unit 105*c* displays the workpiece arrangement by the pallet number, main scanning row number, and sub scanning row number in the example shown in FIG. 19. However, the workpiece arrangement outputting unit 105*c* may display the workpiece arrangement by a method other than the display of the numbers. For example, the workpiece arrangement outputting unit 105*c* may display the workpiece arrangement by a diagram, such as by displaying the images of the workpieces 90 over the image of the pallet 80.

As shown in FIG. 13, the print executing unit 105*d* of the control section 105 generates print data based on the print images 104*d* and print conditions 104*e* included in the print information 104 received in S231 and the image arrangement decided in S242 (S244), and ends the operation shown in FIG. 13.

As described above, the inkjet printing system 10 can present the workpiece arrangement according to the image arrangement (S232, S233, S240) for shortening the total time required for the printing on the plurality of workpieces 90 on the pallet 80 to the user (S243) simply by having the print information 104*b* set by the user (S231). Accordingly, the user of the inkjet printing system 10 can shorten the total time required for the printing on the plurality of workpieces 90 on the pallet 80 by the inkjet printing system 10 simply by arranging the plurality of workpieces 90 on the pallet 80 according to the workpiece arrangement presented by the inkjet printing system 10. That is, the inkjet printing system 10 can simplify the settings that need to be performed by the user for efficient printing on the plurality of workpieces 90 on the pallet 80 compared to in a conventional configuration.

It should be noted that the plurality of print images 104*d* aligned in the main scanning direction shown by the arrow 20*a* do not become problematic in shortening the total time required for the printing in the inkjet printer 20 so long as the specific print condition is the same, even if either one of the workpiece types 104*c* and the print images 104*d* is different from others, as in the four print images 104*d* of which pallet number is "1" and the main scanning row number is "1" as shown in FIG. 18.

The inkjet printing system 10 has the printing numbers 104*f* being the number of print of the print images 104*d* included in the print information 104*b*. According to this configuration, the inkjet printing system 10 does not need to have the user designate the plurality of print information 104*b* having the same workpiece type 104*c*, print image 104*d*, and print condition 104*e* on one by one basis, so that the setting of the print information 104*b* by the user can be simplified as compared to a configuration in which the user must designate the plurality of print information 104*b* having the same workpiece type 104*c*, print image 104*d*, and print condition 104*e* on one by one basis. That is, the inkjet printing system 10 can further simplify the settings that need to be performed by the user for the efficient printing on the plurality of workpieces 90 on the pallet 80.

It should be noted that the inkjet printing system 10 may be configured not being capable of having the printing numbers 104*f* included in the print information 104*b*.

Further, in a case where the number of replacement of the pallets 80 by the transfer device 40, the supply device 50, and the collecting device 60 can be reduced if the plurality of print images 104*d* with the different specific print conditions is aligned in the main scanning direction shown by the arrow 20*a*, the inkjet printing system 10, if printing time required in the state where the plurality of print images 104*d* is aligned in the main scanning direction shown by the arrow 20*a* is shorter than printing time required in a state where the plurality of print images 104*d* is not aligned in the main scanning direction shown by the arrow 20*a* (YES to S237), the image arrangement is decided in the state where the plurality of print images 104*d* is aligned in the main scanning direction shown by the arrow 20*a* (S240, S242). According to this configuration, the inkjet printing system 10 can present the user with the workpiece arrangement in which the time for automatic replacement of the pallets 80 by the transfer device 40, supply device 50, and collecting device 60 is taken into consideration, so that the total time required for the printing on the plurality of workpieces 90 on the pallet 80 can be shortened as compared to a configuration which presents a workpiece arrangement that does not take the time for automatic replacement of the pallets 80 by the transfer device 40, supply device 50, and collecting device 60 into consideration to the user. That is, the inkjet printing system 10 can further enhance efficiency of the printing on the plurality of workpieces 90 on the pallet 80.

It should be noted that as the configuration which presents the workpiece arrangement that does not take the time for automatic replacement of the pallets 80 by the transfer device 40, supply device 50, and collecting device 60 into consideration to the user, for example, there is a configuration that presents a workpiece arrangement in a state where the plurality of print images 104*d* with different specific print conditions never aligns in the main scanning direction shown by the arrow 20*a* to the user, or a configuration that presents a workpiece arrangement in a state where a plurality of main scanning row groups, in which the number of the print images 104*d* becomes 4 or less even after the integration, is integrated without any exception to the user.

The inkjet printing system 10 may be configured to present the workpiece arrangement in which the plurality of print images 104*d* with different specific print conditions never aligns in the main scanning direction shown by the arrow 20*a* to the user, that is, it may be configured to execute the process of S242 directly without executing the processes of S235 to S241 after the process of S234.

Further, the inkjet printing system 10 may be configured to present the workpiece arrangement in which the plurality of main scanning row groups, in which the number of the print images 104*d* becomes 4 or less even after integration, is integrated without any exception to the user, that is, it may be configured to execute the process of S240 without executing the processes of S237 after the processes of S236 and S239.

It should be noted that the inkjet printer 20 is configured to decide the image arrangement in the state where the plurality of print images 104*d* with the same predetermined conditions such as the resolution, pass number, presence/absence of the white base, and number of clear coating, among the print conditions 104*e*, is aligned in the main scanning direction shown by the arrow 20*a* (S233) in the present embodiment. That is, in the present embodiment, the resolution, pass number, presence/absence of the white base, and number of clear coating of the print images 104*d* upon printing configure the specific print conditions of the present invention. However, the specific print conditions of the present invention may be conditions different from those in the present embodiment. For example, the presence/absence of the white base need not be included in the specific print conditions in a case where the inkjet printer 20 is configured to execute at least a part of the one-series of printing operation mutually for the plurality of print images 104*d* aligned in the main scanning direction shown by the arrow 20*a* despite the presence/absence of the white base being different. Similarly, the number of the clear coating need not be included in the specific print conditions in a case where the inkjet printer 20 is configured to execute at least a part of the one-series of printing operation mutually for the plurality of print images 104*d* aligned in the main scanning direction shown by the arrow 20*a* despite the number of the clear coating being different. Further, the resolution need not be included in the specific print conditions in a case where the inkjet printer 20 is configured to execute at least a part of the one-series of printing operation mutually for the plurality of print images 104*d* aligned in the main scanning direction shown by the arrow 20*a* despite the resolution being different.

The specific print conditions of the present invention are four conditions in the present embodiment, namely the resolution, pass number, presence/absence of the white base, and number of the clear coating, among the print conditions 104*e*. That is, in a case where there are conditions included in the print conditions 104*e* other than the resolution, pass number, presence/absence of the white base, and number of the clear coating, such conditions are not the specific print conditions of the present invention in this embodiment. However, the specific print conditions of the present invention may be all of the print conditions 104*e*.

In the present embodiment, the inkjet printer 20 is provided with the display section 102 as the information output section of the present invention. However, the information output section of the present invention may be a device other than the display section 102 so long as it is a device that can output information on the workpiece arrangement to the user. For example, the information output section of the present invention may be a printer that outputs information on the workpiece arrangement for the user by printing the information on the workpiece arrangement on a recording medium such as a sheet.

The inkjet printer 20 is a device that prints an image by ultraviolet curing type ink in the present embodiment, however, it may be a device that, for example, prints an image by ink other than the ultraviolet curing type ink such as solvent ink.

10 Inkjet printing system
20 Inkjet printer
20*a* Arrow (arrow showing main scanning direction)
20*b* Arrow (arrow showing sub scanning direction)
33 Recording head
35 Carriage driving section (relative movement device)
40 Transfer device (stage replacing device)
41 Pallet guiding mechanism (relative movement device)
50 Supply device (stage replacing device)
60 Collecting device (stage replacing device)
80 Pallet (medium mounting stage)
90 Workpiece (target medium)
100 Computer
102 Display section (information output section)
104*a* Inkjet print control program
104*b* Print information
104*c* Workpiece type (medium type)
104*d* Print image
104*e* Print condition
104*f* Printing number (number of printing of print image)
105*a* Print information receiving unit
105*b* Image arrangement deciding unit
105*c* Workpiece arrangement outputting unit (medium arrangement outputting unit)
105*d* Print executing unit

The invention claimed is:

1. An inkjet printing system, comprising: an inkjet printer including a recording head that discharges ink; a relative movement device that relatively moves the recording head in a main scanning direction and a sub scanning direction relative to a medium mounting stage on which a plurality of target media, being media for printing, is capable of being loaded; and an information output section that outputs information, wherein the inkjet printing system comprises:

a print information receiving unit that receives print information being info Illation including medium types that are types of the target media, print images that are images to be printed on the target media, and print conditions for the print images;

an image arrangement deciding unit that decides an image arrangement that is an arrangement on the medium mounting stage of the print images included in the print information received by the print information receiving unit;

a medium arrangement outputting unit that causes the information output section to output a medium arrangement that is an arrangement of the target media in accordance with the image arrangement decided by the image arrangement deciding unit; and a print executing unit that executes printing on the target media on the medium mounting stage by using the recording head and the relative movement device, wherein the print executing unit executes printing based on the print images and the print conditions included in the print information received by the print information receiving unit, and the image arrangement decided by the image arrangement deciding unit, and the image arrangement deciding unit decides the image arrangement in a state where a plurality of the print images with a common specific print condition, which is a predetermined condition among the print conditions, is aligned in the main scanning direction.

2. The inkjet printing system according to claim 1, wherein the print information includes numbers of printing of the print images.

3. The inkjet printing system according to claim 1 or 2 claim 1, further comprising:

a stage replacing device that automatically replaces a medium mounting stage on which a target for printing is loaded among a plurality of the medium mounting stages, wherein the print executing unit executes printing on the target media on the medium mounting stages based on the print images and the print conditions included in the print information received by the print information receiving unit and the image arrangement decided by the image arrangement deciding unit, and by using the recording head, the relative movement device, and the stage replacing device, and in a case where a number of replacement of the medium mounting stages by the stage replacing device decreases when a plurality of the print images with different specific print conditions is aligned in the main scanning direction, the image arrangement deciding unit decides the image arrangement with the state in which said plurality of the print images is aligned in the main scanning direction, if printing time required in the state where said plurality of the print images is aligned in the main scanning direction is shorter than printing time required in a state where said plurality of the print images is not aligned in the main scanning direction.

4. The inkjet printing system according to claim 2, further comprising:

a stage replacing device that automatically replaces a medium mounting stage on which a target for printing is loaded among a plurality of the medium mounting stages, wherein the print executing unit executes printing on the target media on the medium mounting stages based on the print images and the print conditions included in the print information received by the print information receiving unit and the image arrangement decided by the image arrangement deciding unit, and by using the recording head, the relative movement device, and the stage replacing device, and in a case where a number of replacement of the medium mounting stages by the stage replacing device decreases when a plurality of the print images with different specific print conditions is aligned in the main scanning direction, the image arrangement deciding unit decides the image arrangement with the state in which said plurality of the print images is aligned in the main scanning direction, if printing time required in the state where said plurality of the print images is aligned in the main scanning direction is shorter than printing time required in a state where said plurality of the print images is not aligned in the main scanning direction.

5. A non-transitory computer readable medium stored with an inkjet print control program to be executed by a computer provided in an inkjet printing system that is provided with an inkjet printer including a recording head that discharges ink; and a relative movement device that relatively moves the recording head in a main scanning direction and a sub scanning direction relative to a medium mounting stage on which a plurality of target media, being media for printing, is capable of being loaded; and the computer including an information output section that outputs information, and configured to control the inkjet printer, wherein the inkjet print control program causes the computer to function as: a print information receiving unit that receives print information being information including medium types that are types of the target media, print images that are images to be printed on the target media, and print conditions for the print images; an image arrangement deciding unit that decides an image arrangement that is an arrangement on the medium mounting stage of the print images included in the print information received by the print information receiving unit; a medium arrangement outputting unit that causes the information output section to output a medium arrangement that is an arrangement of the target media in accordance with the image arrangement decided by the image arrangement deciding unit; and a print executing unit that executes printing on the target media on the medium mounting stage by using the recording head and the relative movement device, wherein the print executing unit executes printing based on the print images and the print conditions included in the print information received by the print information receiving unit, and the image arrangement decided by the image arrangement deciding unit, and the image arrangement deciding unit decides the image arrangement in a state where a plurality of the print images with a common specific print condition, which is a predetermined condition among the print conditions, is aligned in the main scanning direction.

* * * * *